US009003824B2

(12) United States Patent
Almblad et al.

(10) Patent No.: US 9,003,824 B2
(45) Date of Patent: Apr. 14, 2015

(54) POSITIVE AIR PRESSURE ICE MAKING AND DISPENSING SYSTEM

(75) Inventors: Robert Almblad, Tarpon Springs, FL (US); Susan Clickner, Tarpon Springs, FL (US)

(73) Assignee: Robert Almblad, Lynchburg, VA (US)

( * ) Notice: Subject to any disclaimer, the term of this patent is extended or adjusted under 35 U.S.C. 154(b) by 95 days.

(21) Appl. No.: 13/594,242

(22) Filed: Aug. 24, 2012

(65) Prior Publication Data

US 2013/0167573 A1 Jul. 4, 2013

Related U.S. Application Data

(63) Continuation-in-part of application No. PCT/US2012/023565, filed on Feb. 2, 2012.

(60) Provisional application No. 61/527,526, filed on Aug. 25, 2011, provisional application No. 61/540,663, filed on Sep. 29, 2011, provisional application No. 61/545,254, filed on Oct. 10, 2011, provisional application No. 61/561,490, filed on Nov. 18, 2011, provisional application No. 61/438,696, filed on Feb. 2, 2011, provisional application No. 61/439,996, filed on Feb. 7, 2011, provisional application No. 61/489,446, filed on May 24, 2011.

(51) Int. Cl.

| | |
|---|---|
| ***F25C 1/22*** | (2006.01) |
| ***F25C 1/00*** | (2006.01) |
| ***F25D 23/00*** | (2006.01) |

(52) U.S. Cl.

CPC ..... *F25C 1/00* (2013.01); *F25D 23/003* (2013.01); *F25C 2400/12* (2013.01)

(58) Field of Classification Search

CPC ..... F25C 1/00; F25C 2400/12; F25D 23/003
USPC ..... 62/340, 344, 347, 428
See application file for complete search history.

(56) References Cited

U.S. PATENT DOCUMENTS

| | | | |
|---|---|---|---|
| 2,071,465 | A | 2/1937 | Huber |
| 2,145,773 | A | 1/1939 | Muffly |
| 2,149,000 | A | 2/1939 | Udell |
| 2,387,899 | A | 10/1945 | Gruner |
| 2,821,070 | A | 1/1958 | Watt et al. |

(Continued)

FOREIGN PATENT DOCUMENTS

| | | |
|---|---|---|
| GB | 409499 | 5/1934 |
| WO | WO2010/048241 | 4/2010 |
| WO | WO2012/106484 | 8/2012 |

OTHER PUBLICATIONS

An unofficial International Preliminary Report on Patentability dated Aug. 15, 2013 for International patent application PCT/US2012/023565 filed Feb. 2, 2012; published Aug. 9, 2012 as WO2012/106484; inventor Robert Amblad.

(Continued)

*Primary Examiner* — Mohammad M Ali
(74) *Attorney, Agent, or Firm* — Michael J. Nickerson; Basch & Nickerson LLP

(57) ABSTRACT

An aseptic ice making system includes an ice making system to receive water from a water supply. The ice making system includes an ice producing subsystem to produce ice and a positive air pressure subsystem to maintain a positive air pressure environment within the ice making system.

8 Claims, 22 Drawing Sheets

(56) References Cited

U.S. PATENT DOCUMENTS

| | | | | |
|---|---|---|---|---|
| 3,164,968 | A | 8/1962 | Mullins, Jr. | |
| 3,068,660 | A | 12/1962 | Council et al. | |
| 3,164,986 | A | 1/1965 | Krueger | |
| 3,247,677 | A | 4/1966 | Bussell | |
| 3,392,540 | A | 7/1968 | Council et al. | |
| 3,662,564 | A | 5/1972 | Clearman et al. | |
| 3,686,890 | A | 8/1972 | Lyman | |
| 3,708,992 | A | 1/1973 | Clearman et al. | |
| 3,877,242 | A | 4/1975 | Creager | |
| 4,104,889 | A | 8/1978 | Hoenisch | |
| 4,378,680 | A | 4/1983 | Garland | |
| 4,897,099 | A * | 1/1990 | Ruff | 62/532 |
| 5,216,890 | A | 6/1993 | Ban et al. | |
| 5,267,672 | A | 12/1993 | Jacobsen et al. | |
| 5,293,757 | A | 3/1994 | Nishio | |
| 5,345,782 | A * | 9/1994 | Takahashi et al. | 62/344 |
| 5,354,152 | A | 10/1994 | Reinhardt et al. | |
| 5,549,421 | A | 8/1996 | Reinhardt et al. | |
| 6,109,055 | A * | 8/2000 | Kato et al. | 62/347 |
| 6,148,621 | A * | 11/2000 | Byczynski et al. | 62/73 |
| 6,196,007 | B1 * | 3/2001 | Schlosser et al. | 62/73 |
| 6,224,297 | B1 | 5/2001 | McCann et al. | |
| 6,276,517 | B1 | 8/2001 | Peterson et al. | |
| 6,506,428 | B1 | 1/2003 | Berge et al. | |
| 6,540,067 | B1 | 4/2003 | Sellers et al. | |
| 6,561,691 | B1 | 5/2003 | McCann et al. | |
| 7,032,406 | B2 | 4/2006 | Hollen et al. | |
| 7,168,262 | B2 * | 1/2007 | Hirano et al. | 62/352 |
| 7,197,889 | B2 * | 4/2007 | Wakatsuki et al. | 62/196.4 |
| 2005/0081545 | A1 * | 4/2005 | Gist et al. | 62/217 |
| 2005/0252232 | A1 | 11/2005 | Lee et al. | |
| 2006/0016206 | A1 * | 1/2006 | Gist et al. | 62/340 |
| 2007/0196244 | A1 | 8/2007 | Croft | |
| 2008/0041088 | A1 | 2/2008 | Lee et al. | |
| 2009/0320513 | A1 * | 12/2009 | Yamaoka et al. | 62/340 |
| 2010/0139306 | A1 | 6/2010 | Krenik | |

OTHER PUBLICATIONS

An unofficial International Search Report and Written Opinion dated Jul. 14, 2010 for International patent application PCT/US2009/061404 filed Oct. 21, 2009; published Apr. 29, 2010 as WO2010/048241; inventors Amblad et al.

An unofficial International Search Report and Written Opinion dated Jun. 3, 2013 for International patent application PCT/US2012/023565 filed Feb. 2, 2012; published Aug. 9, 2012 as WO2012/106484; inventor Robert Amblad.

* cited by examiner

POSITIVE AIR PRESSURE ICE MAKING AND DISPENSING SYSTEM

PRIORITY INFORMATION

The present application is a continuation-in-part of PCT Patent Application Number PCT/US2012/023565, filed on Feb. 2, 2012 and claims priority, under 35 U.S.C. §120, from PCT Patent Application Number PCT/US2012/023565, filed on Feb. 2, 2012, said PCT Patent Application Number PCT/US2012/023565, filed on Feb. 2, 2012, claiming priority, 35 U.S.C. §365(c), from U.S. Provisional Patent Application, Ser. No. 61/438,696, filed on Feb. 2, 2011, said PCT Patent Application Number PCT/US2012/023565, filed on Feb. 2, 2012, claiming priority, 35 U.S.C. §365(c), from U.S. Provisional Patent Application, Ser. No. 61/439,996, filed on Feb. 7, 2011, and said PCT Patent Application Number PCT/US2012/023565, filed on Feb. 2, 2012, claiming priority, 35 U.S.C. §365(c), from U.S. Provisional Patent Application, Ser. No. 61/489,446, filed on May 24, 2011. The present application claims priority, under 35 USC §119(e), from U.S. Provisional Patent Application, Ser. No. 61/438,696, filed on Feb. 2, 2011. The present application claims priority, under 35 USC §119(e), from U.S. Provisional Patent Application, Ser. No. 61/439,996, filed on Feb. 7, 2011. The present application claims priority, under 35 USC §119(e), from U.S. Provisional Patent Application, Ser. No. 61/489,446, filed on May 24, 2011.

The present application claims priority, under 35 U.S.C. §119(e), from U.S. Provisional Patent Application Ser. No. 61/527,526, filed on Aug. 25, 2011. The entire content of U.S. Provisional Patent Application Ser. No. 61/527,526, filed on Aug. 25, 2011, is hereby incorporated by reference.

The present application claims priority, under 35 U.S.C. §119(e), from U.S. Provisional Patent Application Ser. No. 61/540,663, filed on Sep. 29, 2011. The entire content of U.S. Provisional Patent Application Ser. No. 61/540,663, filed on Sep. 29, 2011, is hereby incorporated by reference.

The present application claims priority, under 35 U.S.C. §119(e), from U.S. Provisional Patent Application Ser. No. 61/545,254, filed on Oct. 10, 2011. The entire content of U.S. Provisional Patent Application Ser. No. 61/545,254, filed on Oct. 10, 2011, is hereby incorporated by reference.

The present application claims priority, under 35 U.S.C. §119(e), from U.S. Provisional Patent Application Ser. No. 61/561,490, filed on Nov. 18, 2011. The entire content of U.S. Provisional Patent Application Ser. No. 61/561,490, filed on Nov. 18, 2011, is hereby incorporated by reference.

BACKGROUND

Conventional ice making systems and methods can expose the structural components and water/ice to the environment which may contain many contaminants.

An example of a conventional an ice making system and method is disclosed in U.S. Pat. No. 2,149,000. U.S. Pat. No. 2,149,000 shows a method of making chip ice by forming an ice stick in an open ended mold immersed in a body of water to be frozen, then warming the mold to free the ice stick therefrom and permitting ice stick to rise by flotation and then successively cutting off chips of ice from the ice stick as the ice stick rises. The entire content of U.S. Pat. No. 2,149,000 is hereby incorporated by reference.

U.S. Pat. No. 2,145,773 describes a water container having a pair of separate wall areas with a refrigerant evaporator associated with each of the areas connected in parallel in a refrigerant circuit. A thermally controlled valve device alternately closes one and then the other evaporator to control the flow of refrigerant therethrough. The entire content of U.S. Pat. No. 2,145,773 is hereby incorporated by reference.

U.S. Pat. No. 2,821,070 relates to a liquid freezing machine comprising a freezing tube means for refrigerating a tube to freeze liquid therein into a frozen core and means for supplying liquid to be frozen to the tube and for discharging the core from the tube and for discharging the core from the tube including a connection to the tube for supplying liquid to be frozen under pressure to move the core along and out of the tube and at the same time to substantially fill the tube with liquid to be frozen. Liquid flows into the tube at a rate at least as great as that at which the core is ejected from the tube so that the liquid pushes the core from the tube.

A control means operates to open a valve means when the core is to be ejected by the liquid and then to close the valve means to substantially stop the flow of the liquid into the tube upon ejection of the core and upon substantially filling the tube with the liquid to be frozen. A core breaking means is disposed to engage by the core is ejected from the tube and operable to crack the core into pieces. The entire content of U.S. Pat. No. 2,821,070 is hereby incorporated by reference.

U.S. Pat. No. 3,068,660 shows an ice making machine comprising a water tube in which ice is formed, a pump means for circulating water through the tube with a rate of flow sufficient to maintain substantially the entire volume of liquid water in the tube in circulation during the ice freezing operation, a means for refrigerating the water in the tube to form a deposit of ice in the tube, a means for sensing when a predetermined deposit of ice has formed in the tube, means actuated by the sensing means for initiating a thawing operation to loosen the deposited ice in the tube sufficiently to permit movement of the ice through the tube and a means responsive to initiation of the thawing operation for increasing the water flow rate to the tube to cause ejection of the ice from the tube. The entire content of U.S. Pat. No. 3,068,660 is hereby incorporated by reference.

U.S. Pat. No. 3,164,968 describes a liquid freezing machine comprising a freezing tube having an outlet and inlet formed at opposite ends thereof, and a means for supplying the tube between the inlet and the end adjacent thereto with liquid to be frozen through the portion of the freezing tube between the inlet and the outlet. A refrigerating means associated with the freezing tube is disposed to freeze the liquid in the tube into a solid plug. A heating means associated with the freezing tube selectively melts the frozen liquid adjacent the inside of the tube so that the pressure of circulating liquid forces the solid plug of frozen liquid out of the freezing tube. The entire content of U.S. Pat. No. 3,164,968 is hereby incorporated by reference.

U.S. Pat. No. 3,247,677 shows an ice machine having a tubular member with means for pumping water through the tubular member, a means for circulating a refrigerant in contact with an ice making zone of the tubular member, a cooling means for reducing the temperature of the refrigerant below the freezing point of water whereby circulation of the cooled refrigerant in contact with the tubular member will form ice within the ice making zone of the tubular member and a means to bypass the cooling means to subject the tubular member to refrigerant at a temperature in excess of the freezing point of water to free the ice formed within the ice making zone of the tubular member. The entire content of U.S. Pat. No. 3,247,677 is hereby incorporated by reference.

U.S. Pat. No. 3,392,540 relates to a machine for making ice pellets by circulating water to a refrigerant-jacketed inner tube of an evaporator. A pressure sensitive switch stops the flow of refrigerant to the jacket and substitutes hot gas for thawing when the ice formed in the tube is to be harvested. The entire content of U.S. Pat. No. 3,392,540 is hereby incorporated by reference.

U.S. Pat. No. 3,877,242 describes a harvest control unit for an ice-making machine comprising an activatable switch to provide an output signal for electrically initiating a harvest of ice from the machine. The entire content of U.S. Pat. No. 3,877,242 is hereby incorporated by reference.

U.S. Pat. No. 4,104,889 shows an apparatus for transferring ice cubes from a first location to a remote second location including a conduit system between the two locations and a source of air for causing ice to be moved through the conduit system between the two locations. The apparatus further includes diverter means whereby ice cubes being transmitted from the first location to the second location may be diverted to a third location. The entire content of U.S. Pat. No. 4,104,889 is hereby incorporated by reference.

U.S. Pat. No. 6,540,067 relates to an ice transport assembly to transport ice including a sleeve and a tapered auger. Ice at the inlet is transported through a frusto-conically shaped channel and out of an outlet by rotating the tapered auger. The entire content of U.S. Pat. No. 6,540,067 is hereby incorporated by reference.

U.S. Pat. No. 4,378,680 teaches a shell and tube ice-maker with a hot gas defrost having a bottom compartment in which trapped refrigerant gas is present to prevent entry of liquid refrigerant into the compartment during ice-making and from which, during defrosting, hot gaseous refrigerant flows upwardly into the liquid refrigerant which remains in flooded condition around the tubes, whereby delay in initiating further ice-making is minimized. The entire content of U.S. Pat. No. 4,378,680 is hereby incorporated by reference.

U.S. Pat. No. 7,032,406 relates to an ice machine comprising a condensate collection unit disposed beneath an evaporator to collect condensate therefrom and a sump to remove condensate from the ice machine without making contact with recirculated water. The entire content of U.S. Pat. No. 7,032,406 is hereby incorporated by reference.

U.S. Pat. No. 2,387,899 shows an ice-making machine to freeze flowing water within an elongated ice-forming tube into an elongated ice stick or rod and then defrosting the elongated ice-forming tube to release the elongated ice stick or rod therefrom. Once released, the ice stick or rod is broken up into small pieces or fragments for use in icing water coolers or other such structures. The entire content of U.S. Pat. No. 2,387,899 is hereby incorporated by reference.

In the various conventional systems for making and dispensing ice, the conventional ice maker receives water from a water system (that typically has minimum water quality standards) and makes ice while exposing the water, the forming ice, and the ice to ambient air. By allowing the pre-frozen water and the ice to be exposed to the ambient environment, airborne pathogens may come in contact with the water/ice, thereby potentially contaminating the product with harmful pathogens.

For example, the average 1 cubic meter of air contains 35,000,000 particles. In the conventional systems, there is a potential sanitation problem with the exposure of the ice to airborne pathogens. Also, the conventional systems need continual sanitation of the equipment to prevent microbial growth due to airborne mold and bacteria contaminating the moist surfaces of the conventional ice machines.

This exposure to airborne pathogens can lead to visible contamination, unpleasant odors, reliability issues, health inspector issues, and contaminated ice.

In many conventional ice machines, the conventional ice machines draw air for the cooling cycle from the floor drain below the ice machine. By drawing air from below the ice machine, near the floor drain, the conventional ice machines are drawing from a high probable contaminated source, thereby illuminating the need to reduce/eliminate the exposure of the ice making process to the ambient conditions, especially when the ambient conditions have a high probability of having harmful pathogens therein.

In addition, ice machines, conventionally, have relied upon manual sanitizing, automatic sanitizing, ozone, chlorine dioxide, and/or ultraviolet light to reduce/prevent microbial growth.

With respect to manual cleaning, it is conventionally recommended by manufacturers to be done every six months. This process is time-consuming, may require hazardous chemicals, bin cleaning is difficult and disruptive and leads to possible ice waste, and is susceptible to timing and quality issues with respect to when or how well the manual process is performed.

With respect to automatic sanitizing, this process conventionally only sanitizes water contact areas, does not clean the bin or dispenser, and/or may lead to a false sense of security, making the operator incorrectly believe that the ice machine is being fully sanitized.

With respect to ozone, this process conventionally is highly effective, but the process can be toxic if overdone or ineffective if done too little. The ozone process also does provide a reliable measurement of the quality of the sanitizing process, reacts with rubber parts, and/or does not clean the bin. Lastly, ozone generators can be expensive and require periodic maintenance.

With respect to chlorine dioxide, this process conventionally is highly effective, but is costly and potentially hazardous.

With respect to ultraviolet light, this process conventionally can be highly effective, but significant safety and maintenance issues.

In summary, the various conventional systems have drawbacks, can rely on hazardous material, and/or not all clean the ice bin, thereby preventing the production of clean ice.

Conventional systems allow ice machines to get dirty from airborne contamination and then attempt to kill the microorganisms after the microorganisms contaminate the machine.

Conventionally, the microorganisms may be killed after these microorganisms have entered the food zone of the ice machine by actively killing the pathogens using treated surfaces in the food zone, ultraviolet light, or ozone; or by shutting down the machine and killing the pathogens with chemicals which may be poisonous to humans.

An example of a treated surface is the addition of an anti-microbial agent, such as Agion™ anti-microbial, to the materials used to construct the food zone of the ice machine.

It is noted that using an anti-microbial surface material is only effective in killing pathogens if the pathogens come into direct contact with the anti-microbial surface material. This is also true with the use of ozone or ultraviolet light.

However, in the conventional ice machine environment, using this method of killing pathogens is not effective because the ice in the storage bin is mostly in contact with itself, not with the anti-microbial surface area material of the ice machine. Moreover, if slime covers the anti-microbial surface area material, the anti-microbial surface area material must be washed to regain its killing effectiveness.

In contrast, high efficiency particulate filtered positive air pressure keeps an ice machine and bin from being contaminated with air-borne microorganisms. In other words, high efficiency particulate filtered positive air pressure prevents air-borne microorganisms from entering the ice making environment, thereby substantially eliminating the need to clean the ice making system.

Therefore, it is desirable to provide an ice machine that keeps the water, the forming ice, and the ice stored in the ice bin clean.

Moreover, it is desirable to provide an ice machine that makes and stores ice in a cleanroom environment, by preventing contamination and biological growth, keeping the ice and equipment clean at all times, avoiding the use of hazardous materials, and virtually (effectively) eliminating the need to sanitize.

Furthermore, it is desirable to provide an ice machine that substantially eliminates the exposure of the ice making and storing process from ambient contaminants and/or other harmful biological growth, keeping the ice and equipment clean at all times, avoiding the use of hazardous materials, and virtually (effectively) eliminating the need to sanitize.

In addition, in the conventional ice machine environment, there are two zones: the food zone and the mechanical zone, in which there are numerous holes that need to be plugged between the food zone and the mechanical zone, thereby resulting in many holes not being properly sealed during the manufacture process.

If the mechanical zone has a condenser with a fan, the fan will blow or draw air through the condenser to dissipate the heat created when making the ice. In other words, when the condenser fan is turned ON, the condenser fan can blow or draw air through the food zone if the food zone is not sealed properly.

Therefore, it is desirable to provide an ice machine that includes a sealed unitary condenser unit that has a condenser, fan, and fan motor, thereby effectively reducing the air which may be blown into or drawn from the food zone.

As noted above, in the conventional ice machine environment, when the condenser fan is turned ON, it creates either positive or negative air pressure in the mechanical zone which in turn pushes or pulls ambient air through the food zone.

However, the condenser fan is only turned ON intermittently. Thus, when the condenser fan is OFF, and ice is dropped out from an ice automatic ice dispenser, the ice is replaced by air, which is usually sourced from outside the food zone.

In a solution proposed above, high efficiency particulate filtered positive air pressure is realized to prevent air-borne microorganisms from entering the ice making environment.

However, when high efficiency particulate filtered positive air pressure is provided in the ice machine, it has the adverse effect of melting some of the ice.

Therefore, it is desirable to provide an ice machine that includes a high efficiency particulate filtered positive air pressure environment and reduces ice melt.

It is further noted that high efficiency particulate air filtered ice machines need to have field service when installed and continued service thereafter. This service may include commissioning the machine by testing with a certified particle counter and classifying the ice machine with the correct cleanroom classification.

Over time, additional testing is required to verify that the ice machine is maintaining its cleanroom standard, particularly after any filter change.

Also, the ice machine needs to be cultured on a regular basis so that if the ice machine ever becomes biologically unsafe, the ice machine can be sanitized as needed. If the owner of the ice machine does not continue to maintain the cleanroom standard because of not changing the air filter or not culturing on a regular basis, people may become ill from eating the ice from the machine.

Therefore, it is desirable to provide an ice machine that includes a high efficiency particulate filtered positive air pressure environment, wherein the ice machine cannot be operated unless a proper high efficiency particulate air filtering system has been installed.

In addition, it is desirable to provide an ice machine that includes a high efficiency particulate filtered positive air pressure environment, wherein a culture of the ice machine can be realized without substantially interrupting the high efficiency particulate filtered positive air pressure environment.

Lastly, as noted above, in a high efficiency particulate air filtered ice machine, the high efficiency particulate air filters must be changed on a regular basis to maintain clean ice. Also, the actual high efficiency particulate air filter that is used should meet the manufacturer's standards because an inferior high efficiency particulate air filter may fail, causing the production of un-safe ice.

Therefore, it is desirable to provide an ice machine that includes a high efficiency particulate filtered positive air pressure environment, wherein the ice machine can verify that an authorized the high efficiency particulate air filter has been installed.

In addition, it is desirable to provide an ice machine that includes a high efficiency particulate filtered positive air pressure environment, wherein the ice machine can monitor the life of the high efficiency particulate air filter and provide feedback to the owner about replacement and/or shutdown the ice machine when the high efficiency particulate air filter is no longer effective.

BRIEF DESCRIPTION OF THE DRAWING

The drawings are only for purposes of illustrating various embodiments and are not to be construed as limiting, wherein.

DETAILED DESCRIPTION OF THE DRAWINGS

Figure 1:
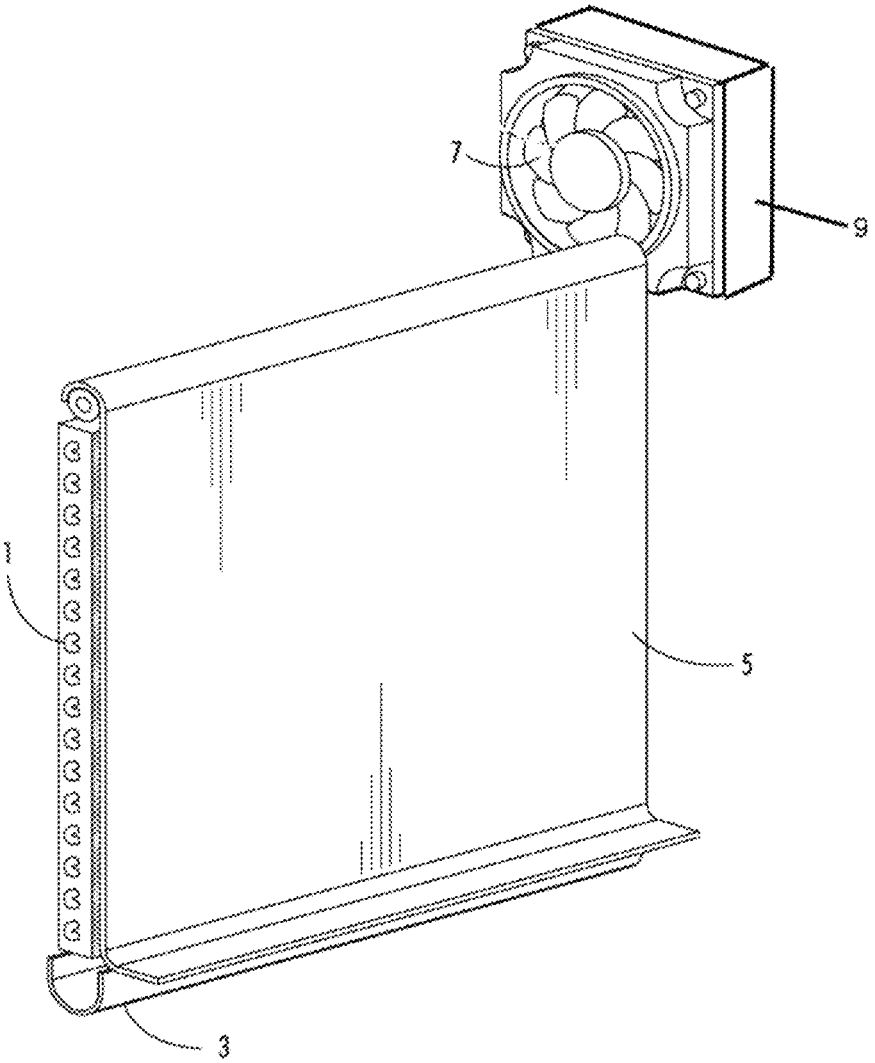
FIG. 1 illustrates a sealed positive air pressure ice making machine evaporator adaptor.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts could be properly illustrated.

An aseptic ice making and dispensing system produces and dispenses ice cubes in a closed loop process, thereby isolating the water supply and ice from the environs during the ice making and dispensing process and virtually eliminating exposure to contaminants normally experienced in an ice making environment.

As described below, the aseptic ice making system includes an ice producing section to produce ice, an ice storage section to receive the produced ice and store for subsequent dispensing, a positive air pressure system to provide a positive air environment within the ice making machine, and a system control section to control the operations of and environment within the aseptic ice making system.

As shown in FIG. 1, the ice producing section of the aseptic ice making system includes a cuber/evaporator 1 which produces the ice cubes. The ice producing section further includes a door 5, which swings out for enabling ice delivery to an ice bin (not shown). The door 5 provides an air tight seal with the ice producing section.

The ice producing section also includes a sump pump pan 3, which may be disposable, a fan 7, and an air filter 9. The fan turns ON when the ice bin is full to dry out the evaporator 1, thereby preventing the growth of mold.

The fan 7 also provides a positive air pressure environment within the ice producing section, thereby substantially eliminating exposure of the ice making process to ambient contaminants and/or other harmful biological growth.

It is noted that the air filter 9 may be a high efficiency particulate air filter, which assists in substantially eliminating exposure of the ice making process to ambient contaminants and/or other harmful biological growth.

Figure 2:
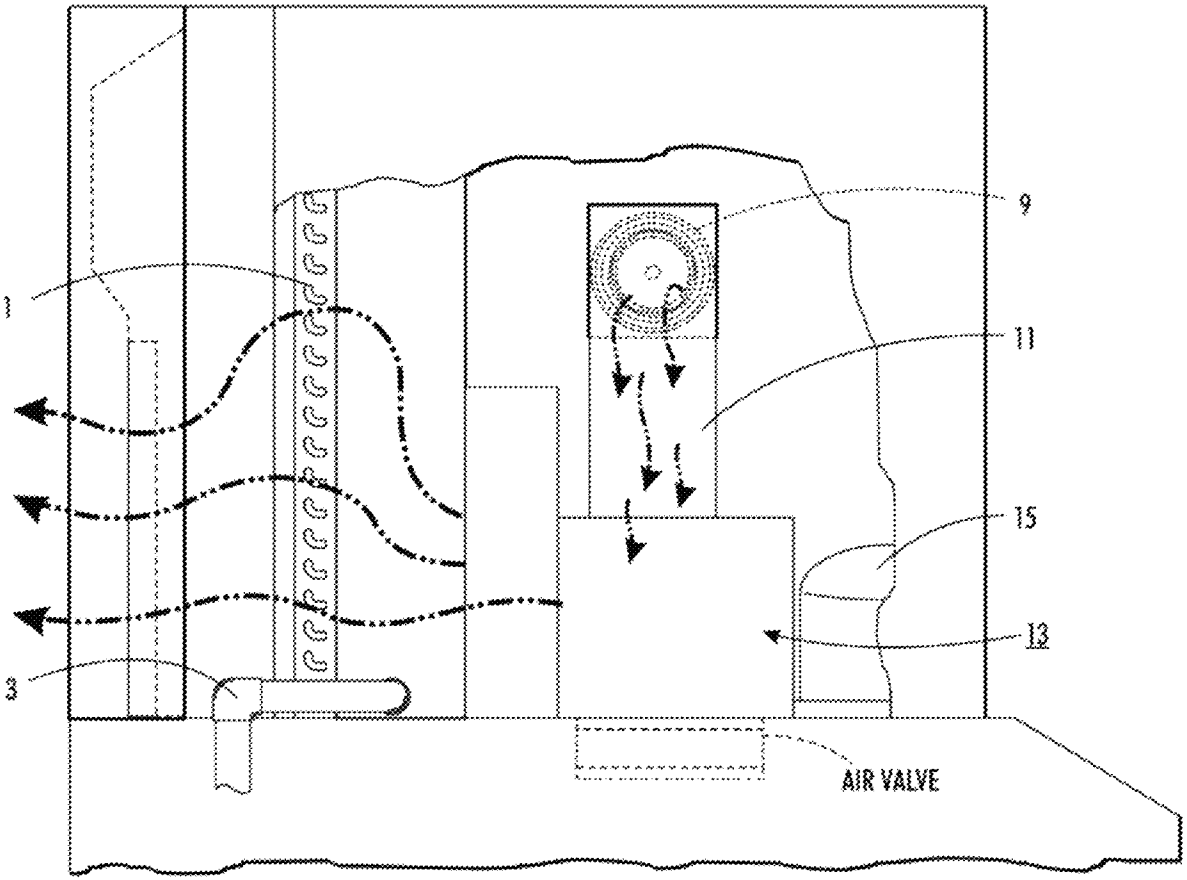
FIG. 2 illustrates pneumatic components of the sealed positive air pressure ice making machine.

As shown in FIG. 2, the various pneumatic components of the sealed positive air pressure ice making machine are illustrated. As noted above, the ice producing section includes a combination of a condenser coil (evaporator) 1 and compressor 15 used to produce the ice cubes. The ice producing section also includes a drip tube or line 3 to divert excess water from a drip pan (not shown) to a sump pump (not shown).

A fan unit, not shown, draws ambient air through an air filter 9, which may be a high efficiency particulate air filter, to push air through air flow chamber 11 and an air value 13 before the air passes over the condenser coil (evaporator) 1.

The air value 13 opens when the fan unit is ON. The air value 13 may automatically close when the enclosed area reaches a predetermined maximum differential pressure air, thereby enabling the creation of a positive air pressure environment.

Figure 3:
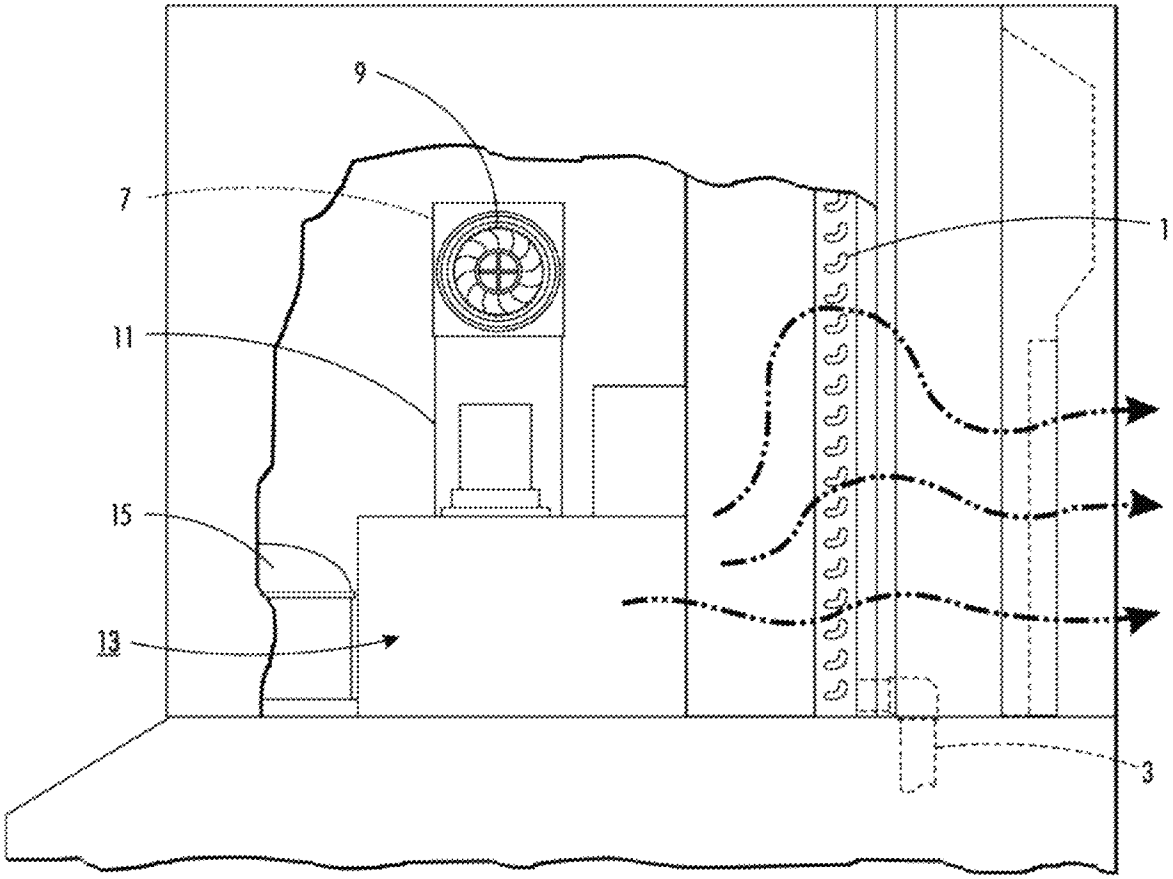
FIG. 3 illustrates further pneumatic components of the sealed positive air pressure ice making machine.

FIG. 3 shows a different view of the components of FIG. 2. As shown in FIG. 3, the ice producing section includes a combination of a condenser coil (evaporator) 1 and compressor 15 used to produce the ice cubes. The ice producing section also includes a drip tube or line 3 to divert excess water from a drip pan (not shown) to a sump pump (not shown).

A fan unit 7 draws ambient air through an air filter 9, which may be a high efficiency particulate air filter, to push air through air flow chamber 11 and an air value 13 before the air passes over the condenser coil (evaporator) 1.

The air value 13 opens when the fan unit 7 is ON. The air value 13 may automatically close when the enclosed area reaches a predetermined maximum differential pressure air, thereby enabling the creation of a positive air pressure environment.

Figure 4:
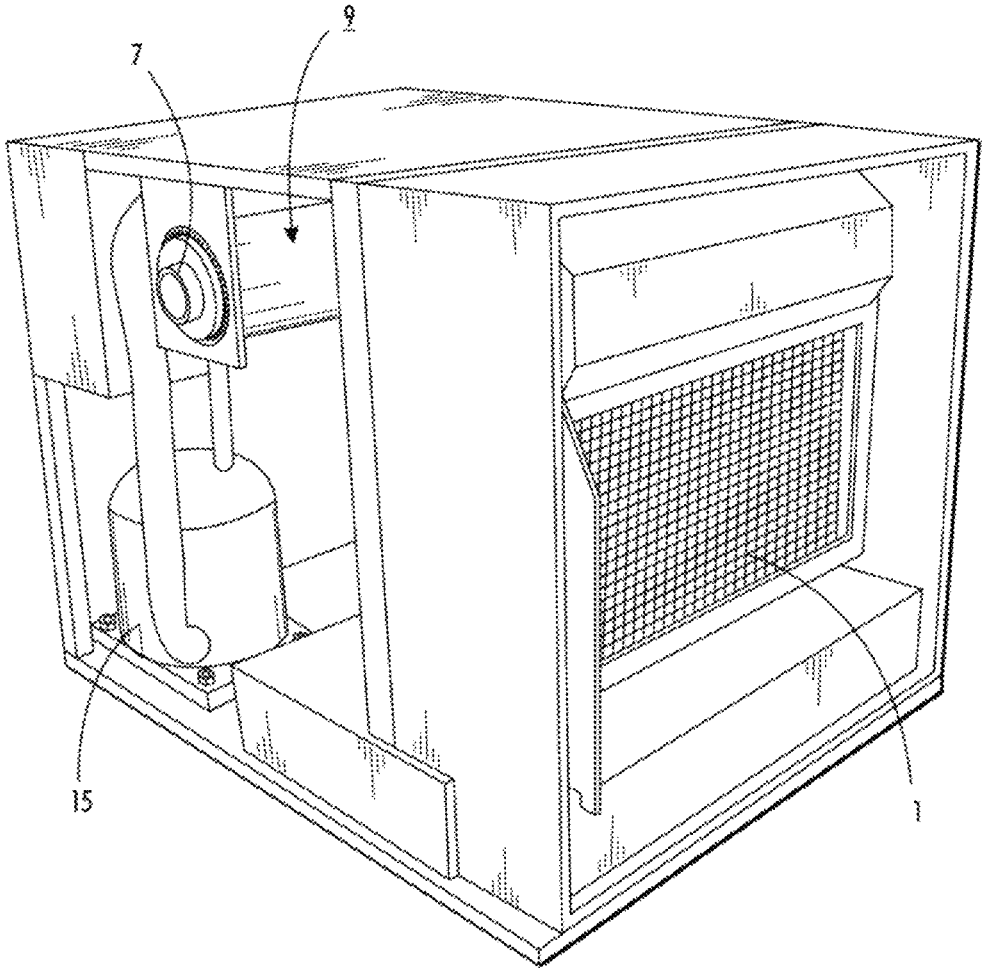
FIG. 4 illustrates a sealed positive air pressure ice making machine evaporator.

FIG. 4 shows another view of the ice producing section. As shown in FIG. 4, the ice producing section includes a combination of a condenser coil (evaporator) 1 and compressor 15 used to produce the ice cubes. A fan unit 7 draws ambient air through an air filter 9, which may be a high efficiency particulate air filter, to push air over the condenser coil (evaporator) 1.

Figure 5:
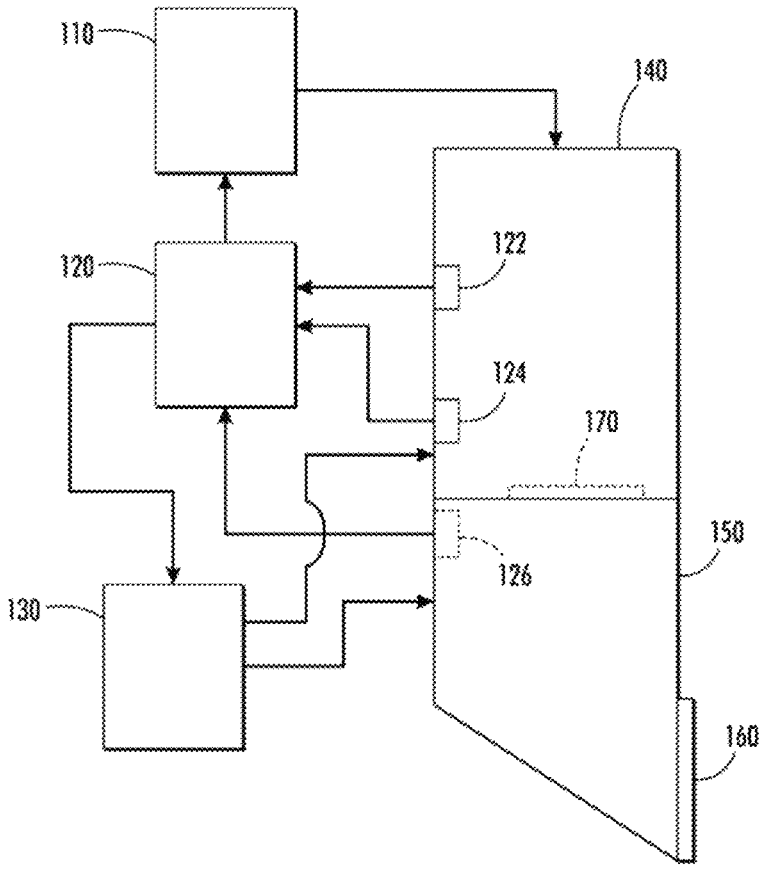
FIG. 5 is a block diagram of a positive air pressure ice making machine.

As shown in FIG. 5, an aseptic ice making system includes an ice producing subsystem 140. The ice producing subsystem 140 includes an evaporator (not shown) and other conventional components (not shown) to produce ice. The ice producing subsystem 140 is coupled to a water supply subsystem 110 which may include filters (such as a reverse osmosis system) (not shown) and/or an ultraviolet system (not shown) to purify the water before the water is received by the ice producing subsystem 140. Also, the water supply subsystem 110 may include the necessary valves (not shown) and regulators (not shown) to control the flow of water to the ice producing subsystem 140.

The ice producing subsystem 140 is also coupled to a positive air pressure supply subsystem 130 which may include filters (such as a high efficiency particulate air filter) (not shown) and/or an ultraviolet system (not shown) to purify the air before the air is pumped into the ice producing subsystem 140 to create the positive air pressure environment within the ice producing subsystem 140. Also, the positive air pressure supply subsystem 130 may include the necessary valves (not shown), fans (not shown), and regulators (not shown) to control the flow of air to the ice producing subsystem 140.

It is noted that the positive air pressure supply subsystem 140 may include a pressurized air canister, which contains purified (sanitized) pressurized air, in lieu of a fan to create the positive air pressure. The pressurized air canister may contain an inert gas or other gas to help retard bacteria growth in the ice producing subsystem 140.

The aseptic ice making system further includes a control system 120 that receives signals from various sensors to control the flow of water and pressurized air to the ice producing subsystem 140.

As illustrated in FIG. 5, the control system 120 is operatively connected to an air pressure sensor 124, located in the ice producing subsystem 140 to monitor the air pressure within the ice producing subsystem 140. If the air pressure (air pressure differential) within the ice producing subsystem 140 drops below a predetermined threshold, the control system 120 causes the positive air pressure supply subsystem 130 to pump air into the ice producing subsystem 140, thereby maintaining the positive air pressure and keeping the ambient air out of the ice producing subsystem 140.

As illustrated in FIG. 5, the control system 120 is also operatively connected to a sensor/controller 122, located in the ice producing subsystem 140 to monitor the progress of the ice-making process within the ice producing subsystem 140. When the ice-making has completed a cycle, the sensor/controller 122 informs the control system 120, which causes the water supply subsystem 110 to pump water into the ice producing subsystem 140 in preparation for the next cycle of ice-making.

The aseptic ice making system also includes an ice storage subsystem 150 which stores the produced ice prior to dispensing. As illustrated, the ice storage subsystem 150 includes a dispensing door or lid 160 which allows the stored ice to be dispensed. The dispensing door or lid 160 forms an airtight seal with the ice storage subsystem 150 so as to maintain a positive air pressure environment within the ice storage subsystem 150.

When the dispensing door or lid 160 is opened to dispense ice, the air pressure within the ice storage subsystem 150 will decrease. The change in air pressure can be monitored by an optional air pressure sensor 126. If the air pressure (air pressure differential) within the ice storage subsystem 150 drops below a predetermined threshold, the control system 120 causes the positive air pressure supply subsystem 130 to pump air into the aseptic ice making system or optionally directly into the ice storage subsystem 150, thereby maintaining the positive air pressure and keeping the ambient air out of the ice storage subsystem 150.

It is noted that the aseptic ice making system may include an optional dispensing door 170 between the ice producing subsystem 140 and the ice storage subsystem 150, thereby creating two airtight compartments.

In this alternative embodiment, the control system 120 would utilize separate air pressure sensors in the ice storage subsystem 150 and the ice producing subsystem 140. Moreover, the control system 120 control the positive air pressure supply subsystem 130 to pump, independently to the ice storage subsystem 50 and the ice producing subsystem 140.

Figure 6:
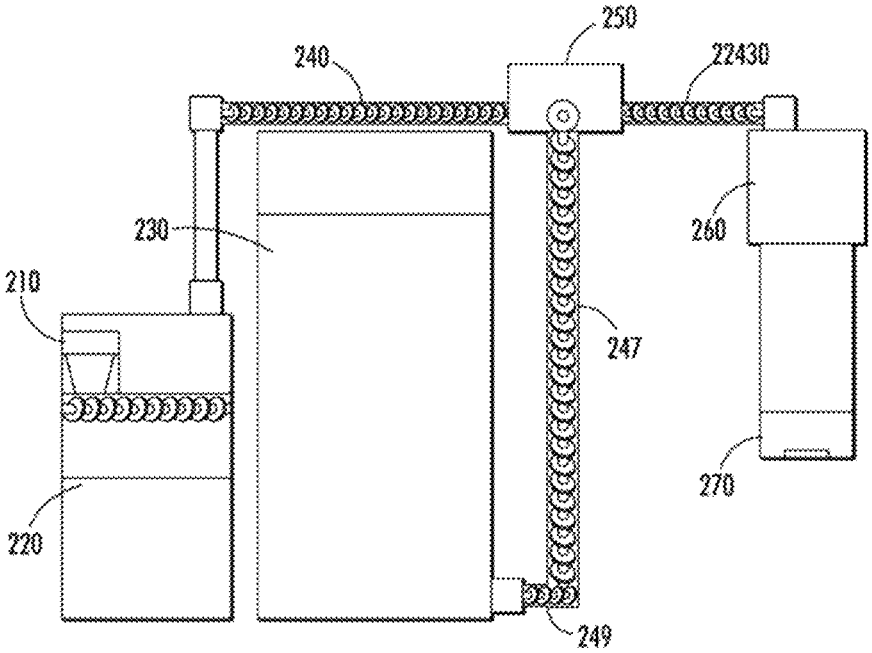
FIG. 6 illustrates a detail view of the ice transport and dispensing system.

FIG. 6 illustrates a positive air pressure ice machine including an ice transport system and an ice dispensing system. As illustrated in FIG. 6, an ice machine 230 produces ice in a positive air pressure environment which includes an ice bin to break up the ice. A detail illustration of the ice bin is show in FIG. 7.

The ice is transported from the ice bin to a vertical auger/tube 247, by auger/tube 249. The ice is transported vertically in vertical auger/tube 247 to an ice distributor 250. The ice may be distributed to an ice bagging system 260 (having a door 270 for dispensing the ice), via auger/tube 243. The ice may also be distributed to an ice bucket 210 or ice/soda dispensing system 220, via auger/tube 240.

Figure 7:
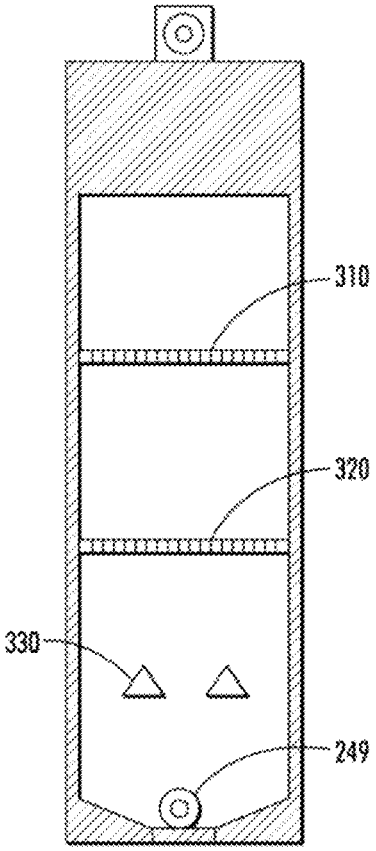
FIG. 7 illustrates a ice making system for producing batches of ice.

As illustrated in FIG. 7, an ice bin has multiple trays (310 and 320) that separate the ice in batches so a large volume of ice can be made overnight and transported to the places it is needed rapidly during the day. The trays perform the function to drop frozen batches of ice over an ice breaking device 330 to break up the ice.

The trays also function to separate the produced ice into manageable volumes so that the batches of ice are not all pushing down on the ice auger 249 at the bottom of the bin, which would tend to break the individual cubes of ice into crushed ice.

The ice bin can auger, as illustrated in FIG. 6, the ice up to a ceiling level, where an ice diverter can further transport the ice to locations where it is needed.

Figure 8:
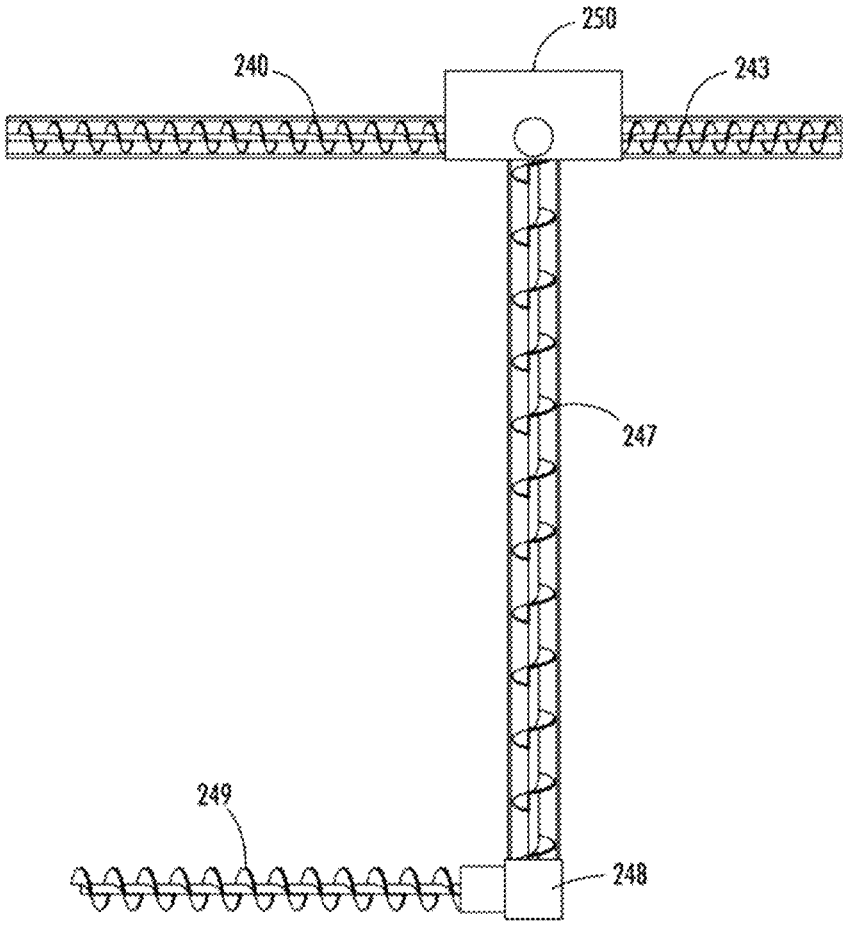
FIG. 8 shows another embodiment of the ice transport system of the ice transport of FIG. 6.

FIG. 8 shows details of the ice transport system. As illustrated in FIG. 8, an auger 249 moves the cubed ice in a horizontal direction towards a collection area 248 for vertical auger/tube 247.

It is noted that auger 249 may also include a tube if the cubed ice is being moved outside the ice bin. It is further noted that although the collection area 248 and vertical auger/tube 247 have been illustrated as being located outside the ice bin, these devices can be located within the ice bin.

The vertical auger/tube 247 moves the ice in a vertical direction to an ice distributor 250. Auger/tube 240 and auger/tube 243 distribute the ice to various stations from the ice distributor 250.

It is noted that the collection area 248 may be replaced with ice distributor 250 so that vertical auger/tube 247 is eliminated. The vertical auger/tube 247 raises the ice to a level so that gravity can also be utilized in the distribution system.

Figure 9:
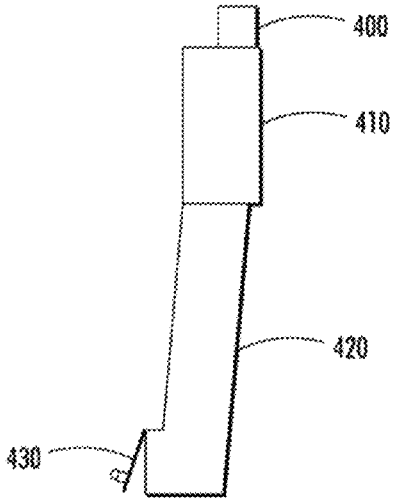
FIGS. 9 and 10 show an ice chute system of the ice transport and dispensing system of FIG. 7.
Figure 10:
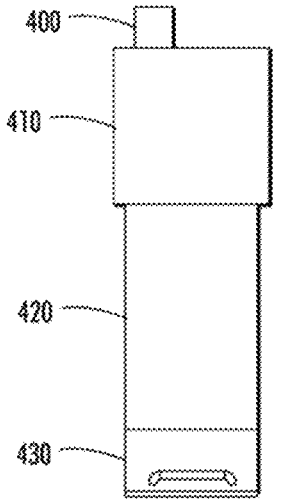

FIG. 9 shows a side view of an ice bagging system, and FIG. 10 shows a front view of the ice bagging system. As illustrated in FIGS. 9 and 10, ice is received by ice inlet 400. Ice inlet 400 may be connected to one of the auger/tubes (240 or 243) of FIG. 8. The ice from ice inlet 400 is received by ice bagging unit 410, which bags the ice for distribution and/or sale. Ice bagging unit 410 may be a conventional bagging device.

Upon being bagged, the bagged ice travels down ice chute 420 so that the bagged ice can be retrieved through door 430. Door 430 is closed-biased to allow the creation of a positive air pressure environment inside the ice bagging device.

It is noted that the ice bagging system may include a positive air pressure supply subsystem that includes a fan and high efficiency particulate air filter and/or an ultraviolet system.

Figure 11:
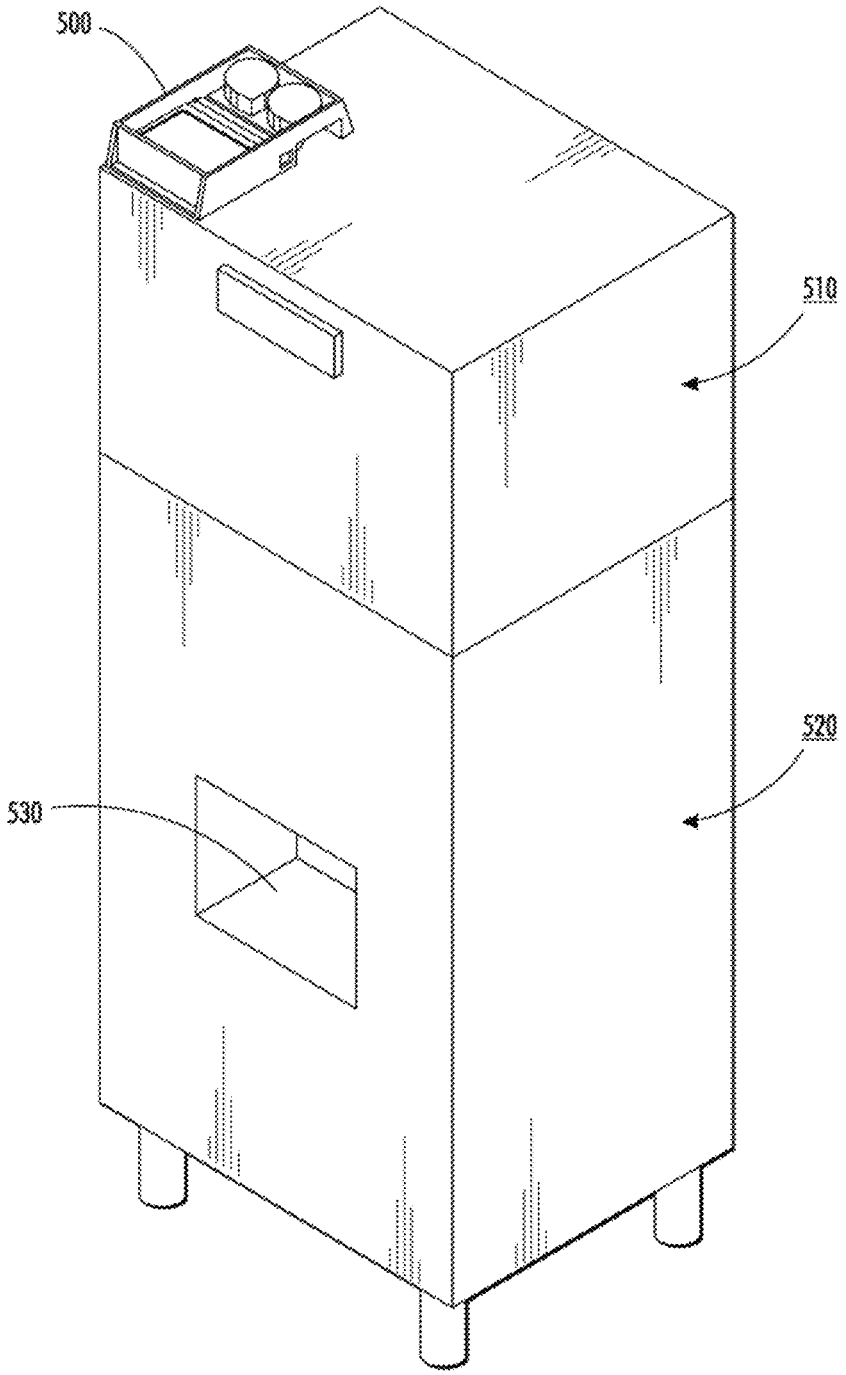
FIG. 11 illustrates an example of a high efficiency particulate air filtered ice machine system.

FIG. 11 illustrates an ice making system with a storage bin. As illustrated in FIG. 11, an ice making device 510 creates ice that is stored in an ice bin 520 for distribution through an ice dispensing device 530. The ice making system includes a positive air pressure supply subsystem 500 that includes a fan and a high efficiency particulate air filter and/or an ultraviolet system.

It is noted that ice dispensing device 530 may include a door, which is spring-biased shut, to allow the creation of a positive air pressure environment inside the ice making system. The ice dispensing device 530 may also be an activatable dispensing device, which transports ice from inside the ice bin 520 to the external environment.

Figure 12:
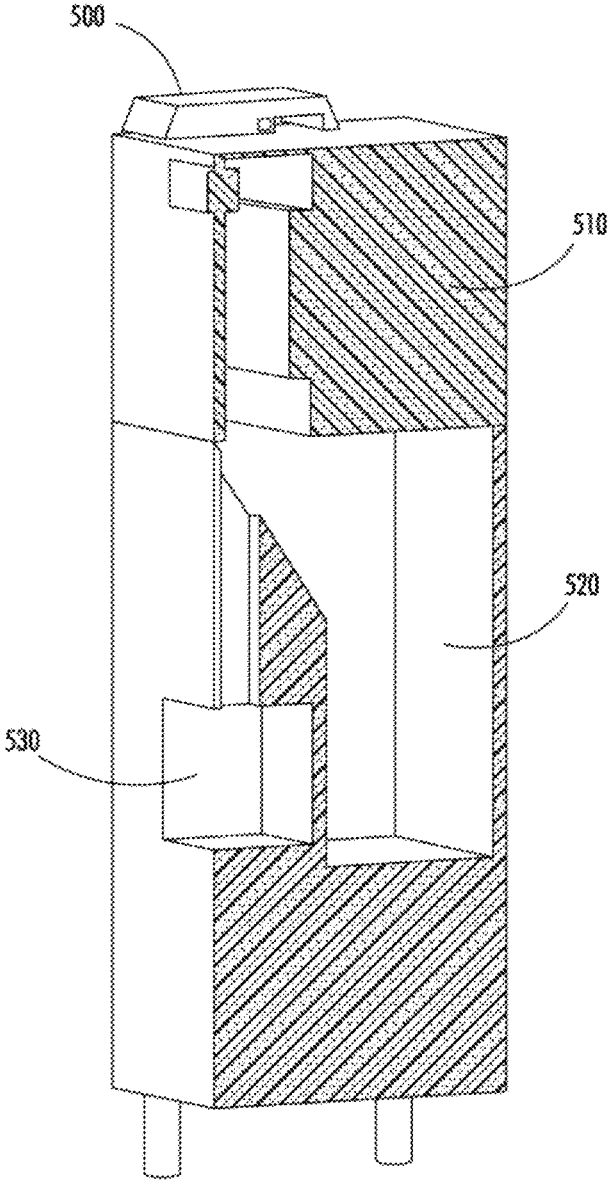
FIG. 12 illustrates a cut-away view of the high efficiency particulate air filtered ice machine system of FIG. 11.

FIG. 12 illustrates a cut-away of the ice making system of FIG. 11. As illustrated in FIG. 12, an ice making device 510 creates ice that is stored in an ice bin 520 for distribution through an ice dispensing device 530, which transports ice from inside the ice bin 520 to the external environment. The ice making system includes a positive air pressure supply subsystem 500 that includes a fan and a high efficiency particulate air filter and/or an ultraviolet system.

It is noted that ice dispensing device 530 may be a door, which is closed-biased, to allow the creation of a positive air pressure environment inside the ice making system.

Figure 13:
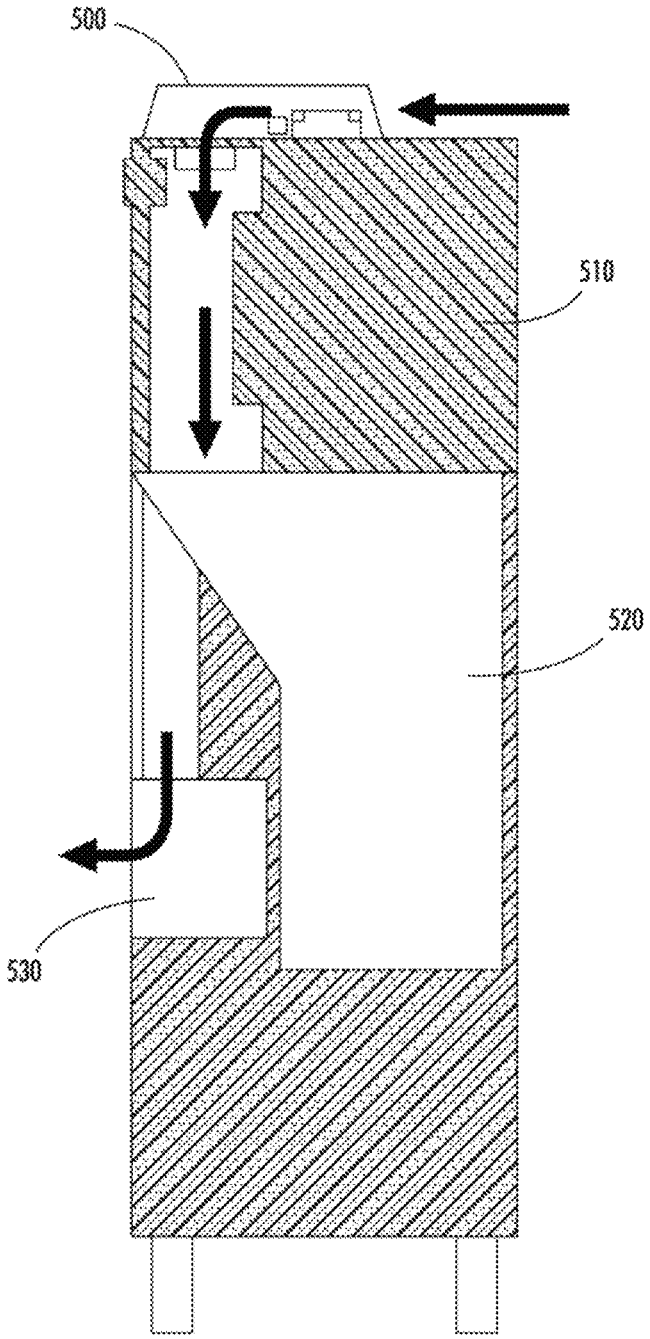
FIG. 13 illustrates the airflow of the high efficiency particulate air filtered ice machine system of FIG. 11.

FIG. 13 illustrates the air flow created by the positive air pressure supply subsystem 500 for the ice making system of FIG. 11. The positive air pressure supply subsystem 500 draws, via a fan, ambient air through a high efficiency particulate air filter and/or an ultraviolet system. The cleaned air flows through the ice making device 510 into the ice storage device 520. When ice is dispensed by ice dispensing device 530, the positive air pressure within the ice making system causes air to flow outward, thereby preventing airborne pathogens or contaminants from entering the ice making system through the dispensing of ice.

Figure 14:
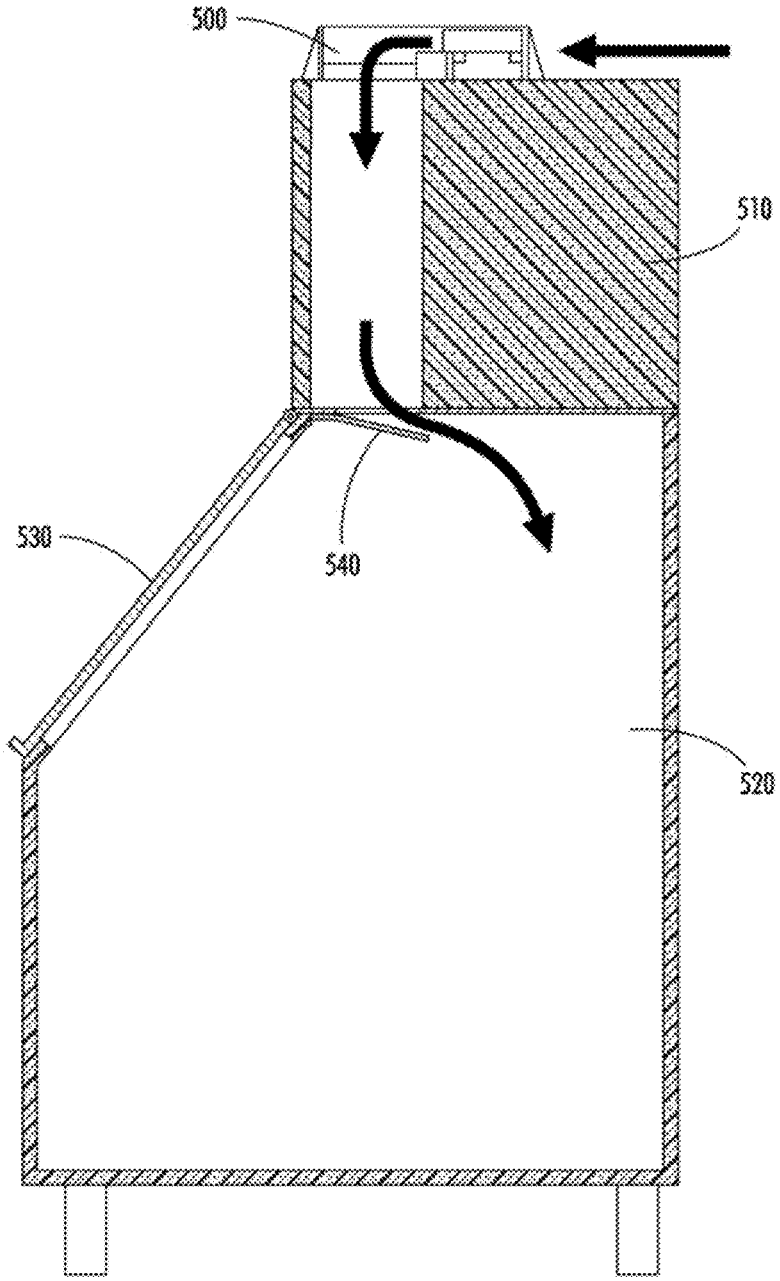
FIG. 14 illustrates the airflow of another high efficiency particulate air filtered ice machine system.

FIG. 14 illustrates the air flow created by the positive air pressure supply subsystem 500 for the ice making system having a door in lieu of an active ice dispensing system. The positive air pressure supply subsystem 500 draws, via a fan, ambient air through a high efficiency particulate air filter and/or an ultraviolet system. The cleaned air flows through the ice making device 510 into the ice storage device 520 through a closed-biased door or hatch 540. The closed-biased door or hatch 540 opens in response to the weight of the ice from the ice making device 510 or the positive air pressure in the ice making device 510 when door 530 is opened. When ice is dispensed through ice dispensing door 530, the positive air pressure within the ice making system causes air to flow outward, thereby preventing airborne pathogens or contaminants from entering the ice making system through the dispensing of ice. It is noted that door 530 creates an air tight seal with the ice storage device 520.

Figure 15:
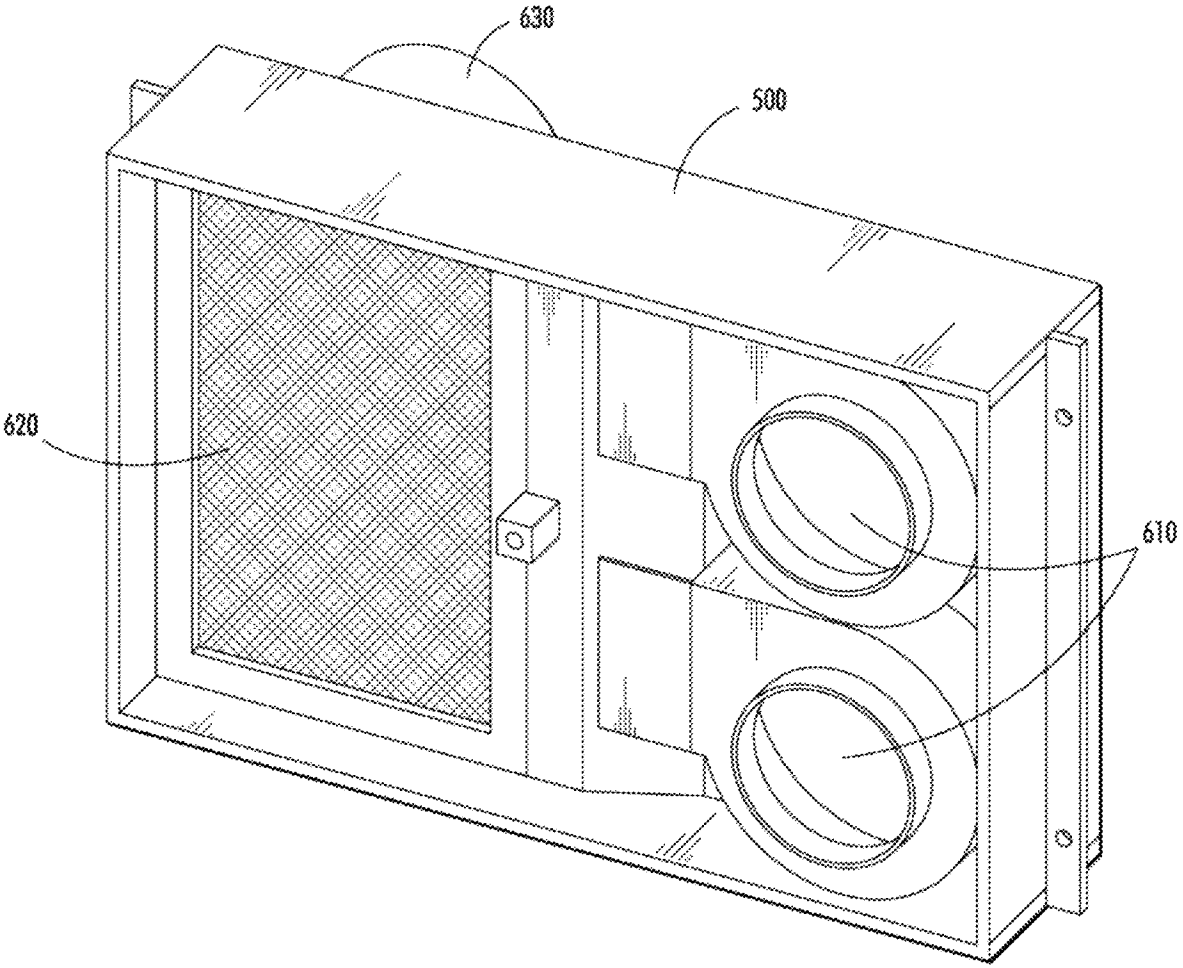
FIG. 15 illustrates an example of high efficiency particulate air filtered positive air pressure generation system.

FIG. 15 illustrates a positive air pressure supply subsystem 500. As illustrated in FIG. 15, the positive air pressure supply subsystem 500 includes two air intakes 610, which have associated fans (not shown). The fans draw ambient air through the intakes 610 and causes the air to pass through a high efficiency particulate air filter 620. The filtered air passes into the ice making system via air outtake 630.

It is noted that the positive air pressure supply subsystem 500 of FIG. 15 may also include an ultraviolet system for killing any biological contaminants.

Figure 16:
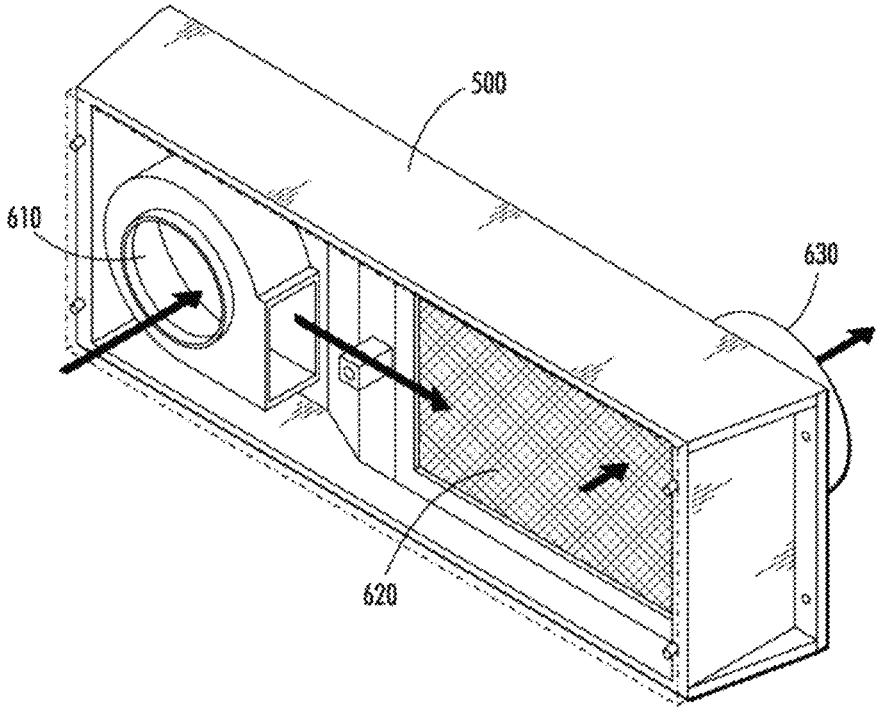
FIG. 16 illustrates another example of high efficiency particulate air filtered positive air pressure generation system.

FIG. 16 illustrates a positive air pressure supply subsystem 500. As illustrated in FIG. 16, the positive air pressure supply subsystem 500 includes a single air intake 610, which has an associated fan (not shown). The fan draws ambient air through the intake 610 and causes the air to pass through a high efficiency particulate air filter 620. The filtered air passes into the ice making system via air outtake 630.

It is noted that the positive air pressure supply subsystem 500 of FIG. 16 may also include an ultraviolet system for killing any biological contaminants.

It is noted that although the above-described embodiments are integral systems, the positive air pressure environment can be created in a conventional ice making device by providing a sealed positive air pressure ice making machine evaporator adaptor. The sealed positive air pressure ice making machine evaporator adaptor would include an evaporator, an air filter (a high efficiency particulate air filter), a fan unit, and an airtight cover/door to allow dispensing of the ice and maintaining of a positive air pressure in the evaporator unit. It is noted that the fan unit can be used to dry out the evaporator when the ice bin is full. The sealed positive air pressure ice making machine evaporator adaptor may also include a plastic disposable sump pump pan.

It is further noted that an aseptic ice making system may include an evaporator, an ice transport section, an ice storage bin and an ice dispense mechanism, which are sealed in cowlings or air shields so that all surfaces are maintained under positive air pressure.

The positive air pressure can be realized with a continual positive air flow. Alternatively, the positive air pressure can be realized by a non-continuous air pumping system or air delivery system. The non-continuous system would reduce the amount of ice melt because the amount of air flowing over the ice would be reduced.

In the non-continuous system, a positive air pressure fan or blower turns ON when the air pressure in the confined area drops below a predetermined threshold; for example, about 0.5 psi.

The drop in air pressure can be the result of air leaks in the system or because the ice dispensing system was activated (opened) and the pressure in the enclosed area has decreased below the minimum level to maintain enough positive pressure to keep the ambient air from entering the ice machine.

When the air pressure drop is sensed, an air valve opens to let blown air (via a high efficiency particulate air filter) into the enclosed area. The fan/blower stays ON and the valve stays open until the pressure reaches a predetermined maximum threshold. Upon reaching the maximum threshold, a valve automatically closes and the fan/blower is turned OFF.

The ice machine's environment remains in a positive air pressure condition until the differential air pressure is less than a predetermined threshold and then the positive air pressure cycle restarts with the valve and fan/blower activating.

In most applications, positive air pressure is maintained by constantly blowing air through a high efficiency particulate air filter and maintaining a predetermined air pressure.

Additionally, the system may include a battery backup or uninterruptible power source so that if there is a temporary loss of power, the fan/blower can operate to maintain sanitary conditions until the power is restored.

The control system of the ice machine may also include memory to store a data log, so that a Hazard Analysis Critical Control Point plan can be tracked and analyzed.

If the ice machine gets turned OFF for too long, the ice machine goes into a "new installation mode" where a similar sanitation takes place as when the machine was first installed.

The ice machine may have numerous sensors; e.g., temperature sensors; to maintain a sanitary condition and to use in the Hazard Analysis Critical Control Point analysis and plan.

As noted above, the ice machine can optionally be fitted with water pre-treatment systems; e.g., a reverse osmosis system; to purify the water and prevent scaling due to mineral build-up.

It is also noted that each high efficiency particulate air filter may have two fans or blowers associated therewith to create a redundant system. Thus, if one blower/fan fails, the other blower/fan will be able to maintain positive air pressure within the ice making system.

Each of the blowers/fans may have a tachometer electrical output that can sense the blower/fan shaft speed, so in case of failure of a blower/fan, a warning signal can be sent to an operator or repair service before the other blower/fan fails.

Additionally, with a reverse osmosis system, the need to purge the water from the ice machine due to mineral concentration as a result of the freezing process would be significantly reduced. Thus, the ice machine reduces water waste in the manufacture of ice.

By using positive air pressure, an ice machine can be used to fill bags of ice at the retail location while maintain sanitary conditions in the packaging of ice itself.

It is noted that in an ice machine, the evaporator, ice transport section, ice storage bin, automatic or manual ice bagging compartment and the ice dispense mechanism may be sealed in cowlings or air shields so that the surfaces are maintained under positive air pressure, which is filtered through a high efficiency particulate air filter.

Also, the packaging that the ice is put into, such as a plastic bag, are opened in the positive air pressure environment, so the air that enters the bag or package will therefore only contain ice and air from the positive air pressure environment.

Limited air flow can be realized by utilizing reduced (size) openings so only a small amount of air flows into and out of the compartment(s), with the incoming air is filtered through a filter, such as a high efficiency particulate air filter.

It is also noted that in an ice transport application, the tubes that transport ice with an air flow will maintain a positive air pressure. The air would flow in the same direction, as the ice, to the exit point.

Ice transport makes it possible to separate ice storage from ice dispensing.

For example, in most eating establishments, a large ice machine with a large storage bin can be placed in a backroom or basement. The ice can be made overnight and at slow times. By utilizing an ice transport system, smaller ice dispensing units can be placed in the front of the restaurant where the ice is needed. To facilitate the non co-located smaller ice dispensing units, the ice transport system transports the ice from the large storage bin in the backroom or basement to multiple areas in the front.

As discussed above, a positive air pressure ice machine also includes an ice bin where a batch of the fresh wet ice made in a positive air pressure ice environment is dropped onto a surface (tray) inside a refrigerated ice bin (positive air pressure ice environment). The ice is allowed to freeze and is then transferred to a tray below and then transferred to the bottom of the bin by gravity, which allows the ice to shatter, but still retain the shape of the original cubes.

In the case of ice machines with bins (FIG. 14), there is a large door 530 that is opened so a large bucket can be put into the ice bin to scoop out ice. This bucket of ice is then manually transported to another location, usually a place where drinks are served, and then dumped into a bin associated with that drink station.

Since there is a very large door in the bin, when the door opens, the air pressure will drop to zero. If a larger blower and high efficiency particulate air filter were placed on top of the ice machine, at some point a minimum level of air pressure would be achieved, but this might require a large blower.

Thus, to keep the blower size small, an air shield (540 of FIG. 14) may be place between the bin and the ice machine. A small opening is formed in the shield, and a flexible flap is placed over the opening. The flap remains closed at all times, except when an ice slab is harvested from the ice machine.

The ice slab drops by gravity through the opening, pushing the flap open. In this way, positive air pressure in the "food zone" of the ice machine can be maintained.

It is further noted that regarding ice transport, ice can be transported in a flexible tube or solid tube without an auger when the tube is maintained in a state of positive air pressure with high efficiency particulate air filtered air. As ice enters the tube, it is transported because the air pressure is increased enough to propel the ice to a remote destination. Thus, the transport tubes are always maintained under positive air pressure from a high efficiency particulate air filter.

Figure 17:
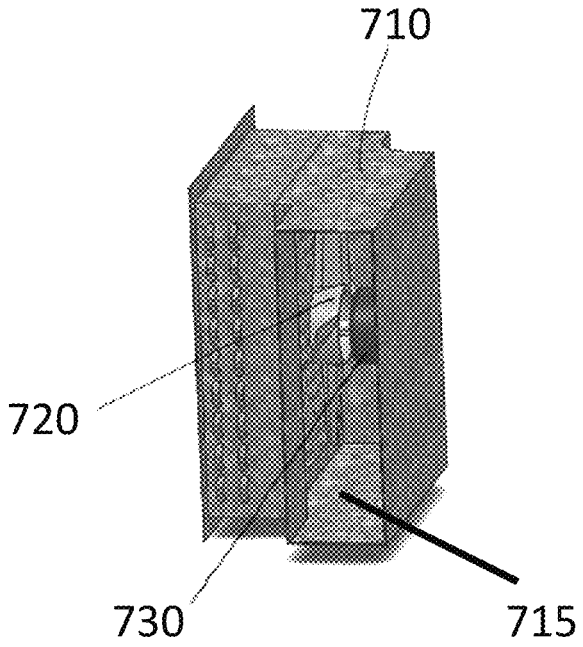
FIG. 17 illustrates a sealed condenser unit for an ice making system.
Figure 19:
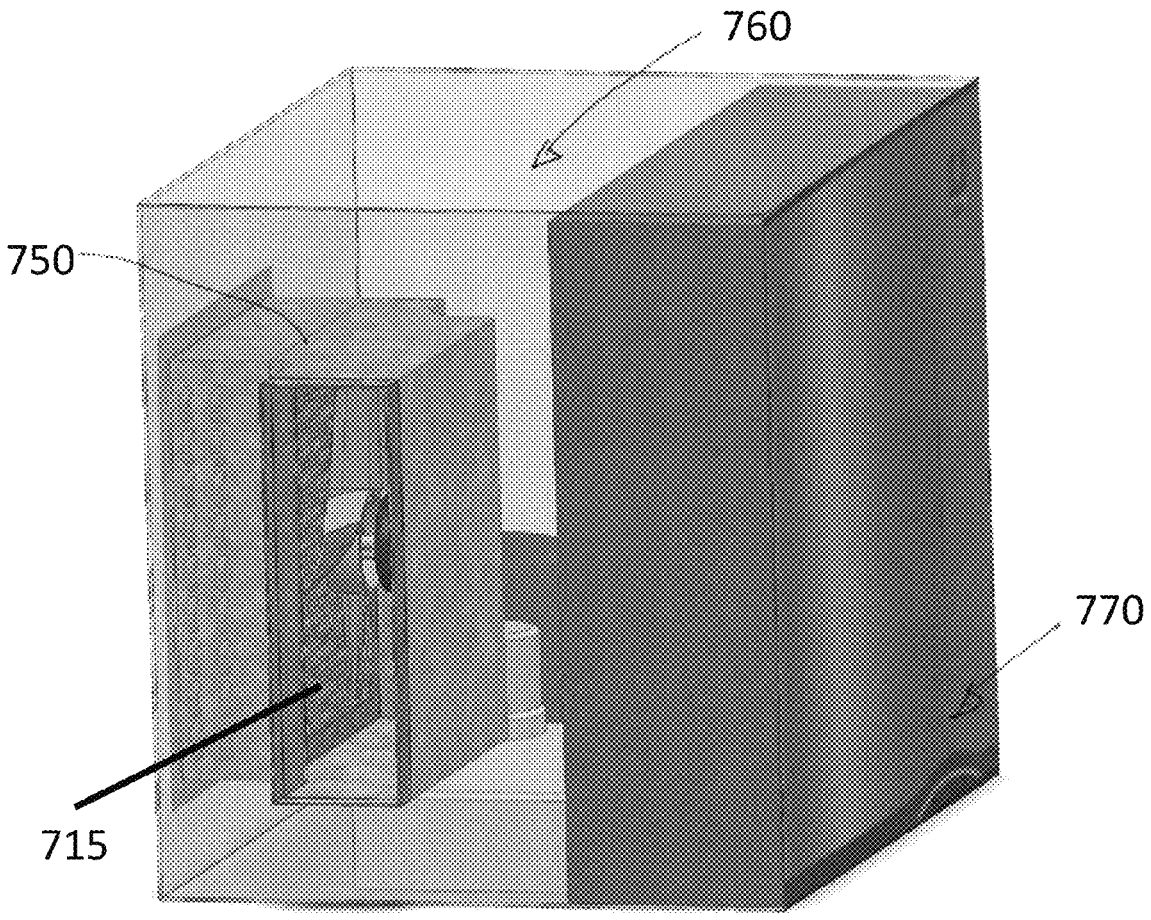
FIG. 19 illustrates a sealed condenser unit installed within an ice making machine.

FIG. 17 illustrates a hermetically sealed condenser unit 710 that includes a motor 730 and a fan 720. The hermetically sealed condenser unit 710 is hermetically sealed with respect to a mechanical zone 760, as illustrated in FIG. 19, and a food (ice) zone 770, as illustrated in FIG. 19. The hermetically sealed condenser unit 710 further includes a channel which receives ambient air from an opening 715. This opening 715 may be located in the exterior wall of the ice machine of other compartment wherein the ambient air is not drawn from a food (ice) zone 770, as illustrated in FIG. 19.

Figure 18:
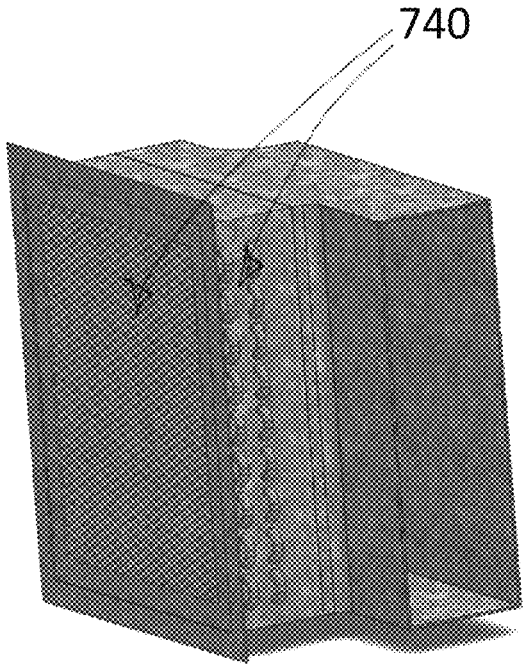
FIG. 18 illustrates another view of a sealed condenser unit for an ice making system.

The ambient air is forced over a condenser 740, as illustrated in FIG. 18, to enable the compressed vapor to remove the heat from the liquidation process being carried out in the condenser 740. The forced air leaves the hermetically sealed condenser unit 710 to the ambient environment (exterior of the ice machine.

As illustrated in FIG. 19, a hermetically sealed condenser unit 750 can be located within the mechanical zone 760. As noted above, the hermetically sealed condenser unit 750 is hermetically sealed with respect to the mechanical zone 760 and the food (ice) zone 770.

Moreover, as illustrated in FIG. 19, the opening 715 for receiving the ambient air is located in the side wall of the mechanical zone 760 so as to receive air from outside the mechanical zone 760.

Figure 20:
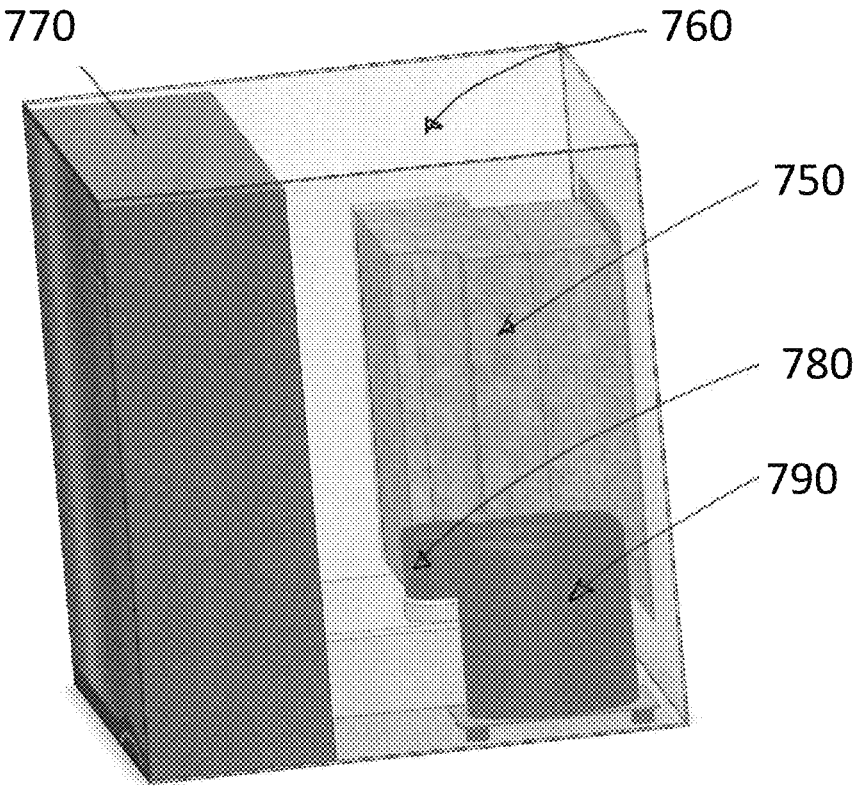
FIG. 20 illustrates another view of a sealed condenser unit installed within an ice making machine.

As illustrated in FIG. 20, a compressor 790 and sump pump 780 can also be located within the mechanical zone 760.

As illustrated in FIGS. 17-20, a hermetically sealed unitary condenser, fan and fan motor unit can be built inside an ice machine, thereby not markedly increasing the size of the machine. By integrating the condenser unit in the ice machine, a three zone ice machine (Food Zone, Mechanical Zone, and Condenser Zone) created in the same or similar foot-print of the original machine.

Figure 21:
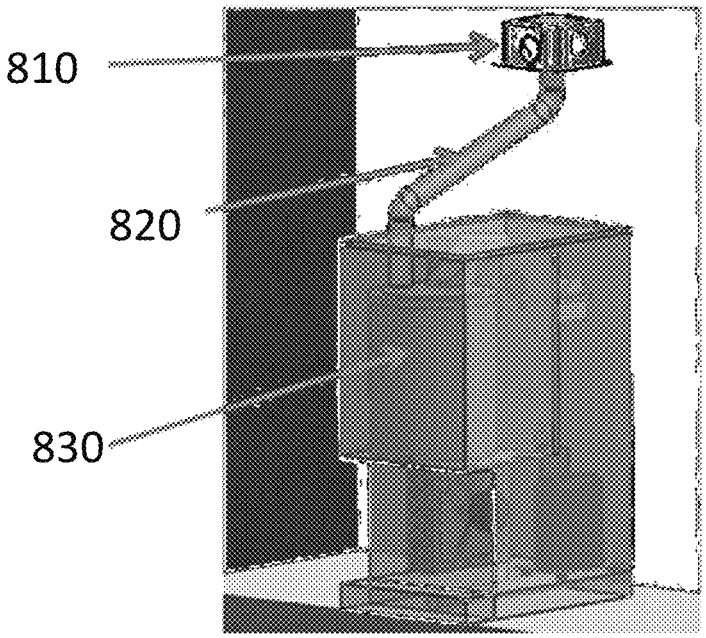
FIG. 21 illustrates an embodiment of a high efficiency particulate air filtered positive air pressure generation system installed on an ice making machine.

FIG. 21 illustrates a two-speed or dual motor high efficiency particulate air filtered ice machine. As illustrated in FIG. 21, a two-speed or dual motor high efficiency particulate air filtered blower 810 provides positive air pressure through a conduit 820 to the ice machine 830.

It is noted that the two-speed or dual motor high efficiency particulate air filtered blower 810 may provide positive air pressure through a conduit 820 to a food (ice) zone of the ice machine 830.

Figure 22:
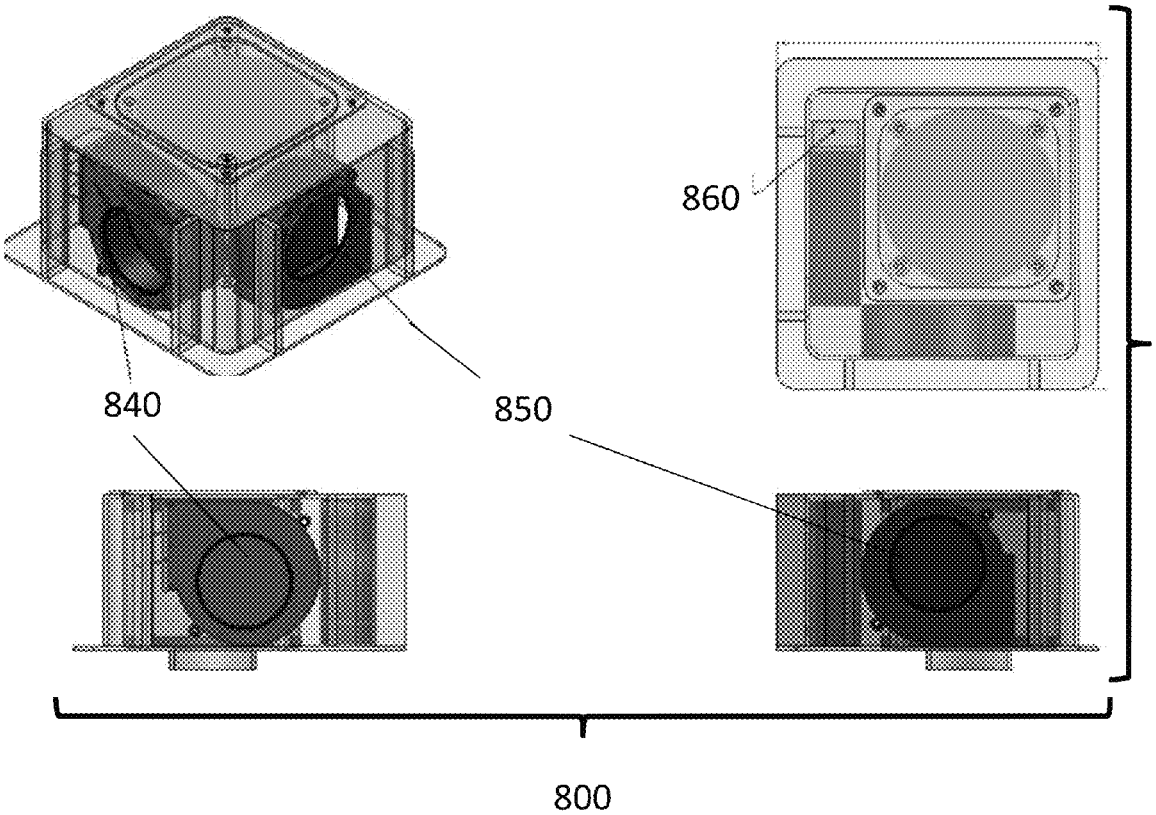
FIG. 22 illustrates another example of a high efficiency particulate air filtered positive air pressure generation system.

As illustrated in FIG. 22, the two-speed or dual motor high efficiency particulate air filtered blower includes a main blower 850 and a backup blower 840. Moreover, the two-speed or dual motor high efficiency particulate air filtered blower may include backup blower flaps 860 which are closed when the backup blower 840 is not in use.

It is noted that instead of two motors, as illustrated in FIG. 22, a single dual speed motor may be used.

The two-speed or dual motor high efficiency particulate air filtered blower blows air into the food zone at two speeds.

For example, the main blower 850 may blow at a low speed when the condenser fan is OFF, and the backup blower 840 may blow at a higher speed when the condenser fan is ON.

If a single two-speed blower is utilized, the blower would blow at a low speed when the condenser fan is OFF and blow at a higher speed when the condenser fan is ON.

By utilizing dual motors or a single dual-speed motor, ice melting is reduced because the low speed is ON all the time, while the high speed is only utilized when the condenser motor is ON.

It is noted that the two-speed or dual motor high efficiency particulate air filtered blower can be placed almost anywhere near the ice machine.

It is noted that existing ice machines can be converted to high efficiency particulate air filtered positive air pressure ice machines by putting a hole in the food zone so that the conduit of the two-speed or dual motor high efficiency particulate air filtered blower can be readily attached to the ice machine.

Additional control circuitry and wiring would be needed so that the two-speed or dual motor high efficiency particulate air filtered blower would operate in synchronism with the operational state of the condenser motor.

To commission or test the high efficiency particulate air filtered positive air pressure ice machine, an installer would use a particle counter to insure the system works.

Figure 23:
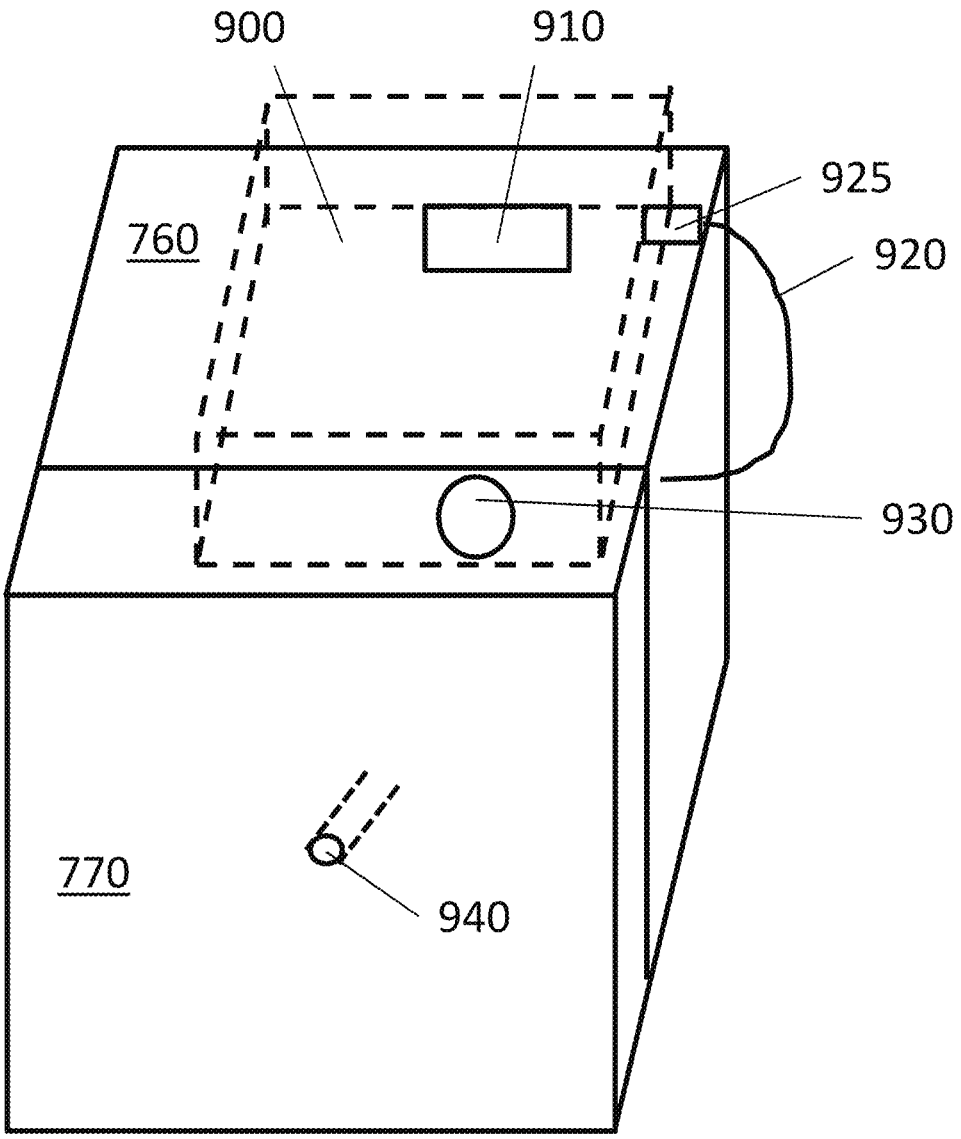
FIG. 23 illustrates a high efficiency particulate air filtered positive air pressure generation system controlled ice making machine.

FIG. 23 illustrates another example of a high efficiency particulate air filtered blower unit 900 integrated with an ice machine.

As illustrated in FIG. 23, the high efficiency particulate air filtered blower unit 900 may include a controller 910 for controlling the operations of the high efficiency particulate air filtered blower unit 900 with respect to the operational state of the condenser motor.

Moreover, the high efficiency particulate air filtered blower unit 900 can be modified to have a receptacle to receive the power plug 925 (power cord 920) provide power to the ice machine so that ice machine cannot operate if the high efficiency particulate air filtered blower unit 900 is not installed.

It is noted that the power plug and receptacle can be uniquely designed to prevent the ice machine to plug into a conventional power source.

Moreover, the controller 910 could interrupt the power to the ice machine if the controller 910 detects any problems with the high efficiency particulate air filtered blower unit 900, such as dirty air filters, malfunctioning blower(s), etc.

The high efficiency particulate air filtered blower unit 900 is connected to the food (ice) zone 770 through opening 930.

As illustrated in FIG. 23, a small hole 940 may be provided in the food (ice) zone 770, which extends to a known dirty location place in the ice machine so that a swabbing device can be inserted into the ice machine for the purposes of taking a culture to determine if the ice machine needs to be sanitized.

Figure 24:
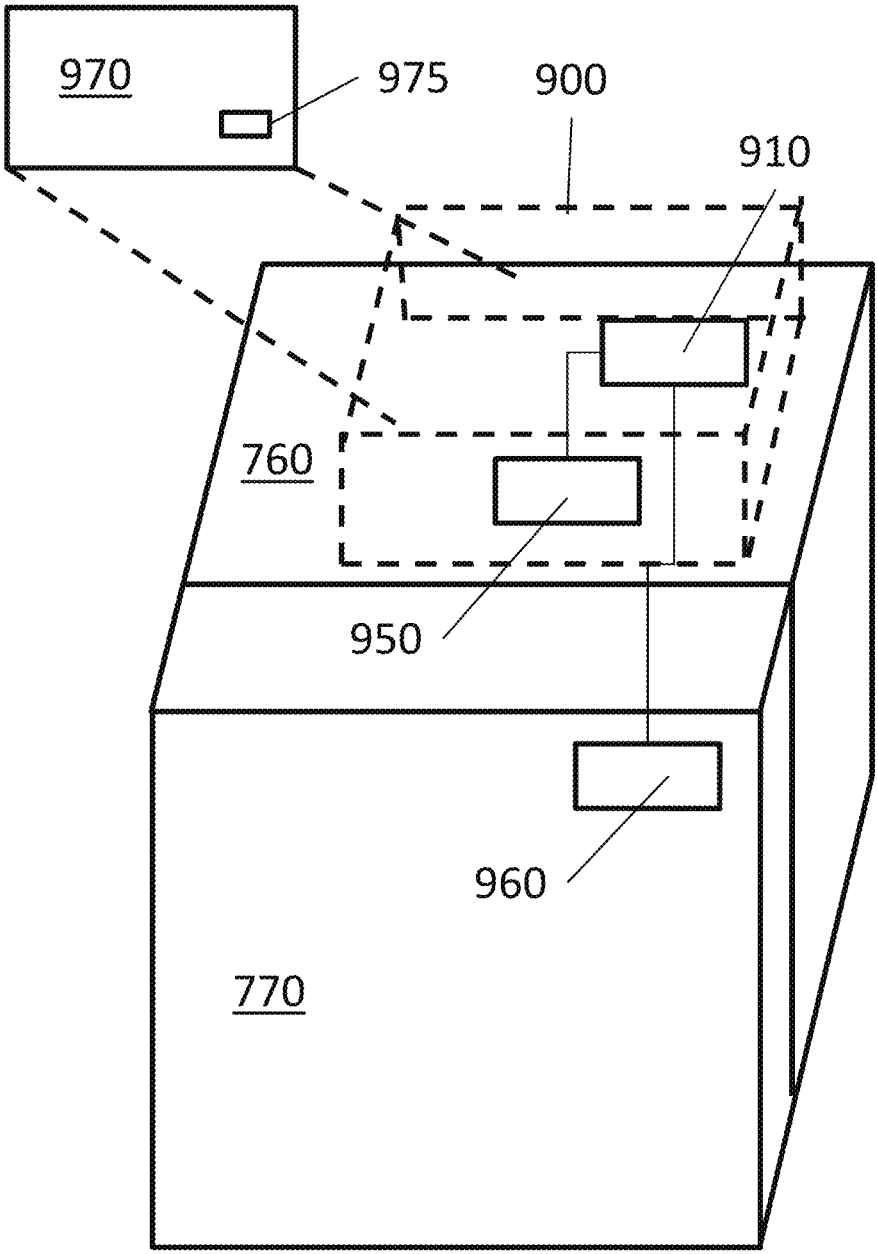
FIG. 24 illustrates a high efficiency particulate air filtered positive air pressure generation system using RFID tagged high efficiency particulate air filters.

As illustrated in FIG. 24, a high efficiency particulate air filtered blower unit 900 may include a controller 910 for controlling the operations of the high efficiency particulate air filtered blower unit 900 with respect to the operational state of the condenser motor.

Moreover, the high efficiency particulate air filtered blower unit 900 may utilize high efficiency particulate air filters 970, which include radio-frequency identification device or other identification device or tag 975, to inform the controller 910 if an authorized high efficiency particulate air filter 970 has been installed.

The radio-frequency identification device or other identification device or tag 975 may be detected by a sensor 950 which communicates to the controller 910. Moreover, the radio-frequency identification device or other identification device or tag 975 may include information about authorization and expected life span. This information is communicated to the controller 910 and used by the controller 910 to properly operate the high efficiency particulate air filtered blower unit 900.

Moreover, as illustrated in FIG. 24, a control panel 960 may be provide to inform the owner of the ice machine if the high efficiency particulate air filter 970 is authorized and/or at the end of life. The control panel 960 may also provide warnings to the owner regarding an approaching end of life and a need to secure additional high efficiency particulate air filters 970.

By utilizing an radio-frequency identification device and reader in test the high efficiency particulate air filtered positive air pressure ice machine and a radio-frequency identification device embedded in the filters, the high efficiency particulate air filtered positive air pressure ice machine's electronics can verify that an authorized filter has been installed, and using an internal clock, warn the ice machine owner that the filter needs to be changed with something like a beeping and if the filter is not changed, turn OFF the machine before the ice becomes unsafe to eat.

It is noted that an ice making system may include an ice making zone for creating ice; a mechanical zone for housing mechanical devices used in making ice; and a sealed condenser unit. The sealed condenser unit may include a fan, a condenser motor to operate the fan, and a condenser. The condenser may be cooled by air blown by the fan. The sealed condenser unit may be sealed with respect to the ice making zone and the mechanical zone. The sealed condenser unit may have a first opening, exterior of the mechanical zone, to enable the operated fan to draw ambient air therefrom. The sealed condenser unit may have a second opening, exterior of the mechanical zone, to expel thereto the air blown by the operated fan.

The sealed condenser unit may be hermetically sealed with respect to the ice making zone and the mechanical zone.

The sealed condenser unit may be located within the mechanical zone.

The sealed condenser unit may be attached to the ice making system and located outside the mechanical zone.

An ice making system may include an ice making system to receive water from a water supply. The ice making system may include an ice producing subsystem to create ice from the received water, the ice producing system including a condenser, and a positive air pressure subsystem to create and maintain a positive air pressure environment within the ice making system. The positive air pressure subsystem may include a first blower and a second blower. The first blower operates at a first speed when the condenser of the ice producing subsystem is operational, and the second blower operates at a second speed when the condenser of the ice producing subsystem is non-operational, the second speed being slower than the first speed.

The positive air pressure subsystem may include an ultraviolet system for irradiating air passing through the positive air pressure subsystem.

The positive air pressure subsystem may include a controller, a pressure sensor, and a high efficiency particulate air filter. The controller activates the second blower when the pressure sensor measures an air pressure within the ice producing subsystem below a predetermined air pressure and the condenser of the ice producing subsystem is non-operational. The controller activates the first blower when the pressure sensor measures an air pressure within the ice producing subsystem below a predetermined air pressure and the condenser of the ice producing subsystem is operational.

The ice making system may include an ice storage device, operatively connected to the ice making system, for storing the created ice; and an air shield located between the ice making system and the ice storage device to maintain a positive air pressure within the ice making system and to enable transference of the created ice from the ice making system to the ice storage device.

The ice making system may include an ice dispensing system, operatively connected to the ice making system, for dispensing the created ice; and an air shield located between the ice making system and the ice dispensing system to maintain a positive air pressure within the ice making system and to enable transference of the created ice from the ice making system through the ice dispensing system.

An ice making system may include an ice making system to receive water from a water supply. The ice making system may include an ice producing subsystem to create ice from the received water, the ice producing system including a condenser, and a positive air pressure subsystem to create and maintain a positive air pressure environment within the ice making system. The positive air pressure subsystem may include a dual speed blower. The dual speed blower may operate at a first speed when the condenser of the ice producing subsystem is operational and operate at a second speed when the condenser of the ice producing subsystem is non-operational, the second speed being slower than the first speed.

The positive air pressure subsystem may include an ultraviolet system for irradiating air passing through the positive air pressure subsystem.

The positive air pressure subsystem may include a controller, a pressure sensor, and a high efficiency particulate air filter. The controller activates the dual speed blower to operate at the second speed when the pressure sensor measures an air pressure within the ice producing subsystem below a predetermined air pressure and the condenser of the ice producing subsystem is non-operational and activates the dual speed blower to operate at the first speed when the pressure sensor measures an air pressure within the ice producing subsystem below a predetermined air pressure and the condenser of the ice producing subsystem is operational.

The ice making system may include an ice storage device, operatively connected to the ice making system, for storing the created ice; and an air shield located between the ice making system and the ice storage device to maintain a positive air pressure within the ice making system and to enable transference of the created ice from the ice making system to the ice storage device.

The ice making system may include an ice dispensing system, operatively connected to the ice making system, for dispensing the created ice; and an air shield located between the ice making system and the ice dispensing system to maintain a positive air pressure within the ice making system and to enable transference of the created ice from the ice making system through the ice dispensing system.

An ice making system may include an ice making system to receive water from a water supply. The ice making system may include an ice producing subsystem to create ice from the received water, the ice producing system including a condenser; a high efficiency particulate filtered air positive air pressure subsystem to create and maintain a positive air pressure environment within the ice making system; and a controller. The controller causes the ice producing subsystem to become non-operational when the controller determines that the high efficiency particulate filtered air positive air pressure subsystem is non-operational.

The ice making system may include an opening that extends from an exterior of the ice making system into an interior of the ice making system to enable a swab device to take a culture sample of an area of interest within the ice making system.

The opening may be configured to reduce any air pressure loss within the ice making system.

An ice making system may include an ice making system to receive water from a water supply. The ice making system may include an ice producing subsystem to create ice from the received water, the ice producing system including a condenser; a high efficiency particulate filtered air positive air pressure subsystem to create and maintain a positive air pressure environment within the ice making system; and a controller. The controller causes the ice producing subsystem to become non-operational when the controller determines that the high efficiency particulate filtered air positive air pressure subsystem is operating incorrectly.

The ice making system may include an opening that extends from an exterior of the ice making system into an interior of the ice making system to enable a swab device to take a culture sample of an area of interest within the ice making system.

The opening may be configured to reduce any air pressure loss within the ice making system.

An ice making system may include an ice making system to receive water from a water supply.

The ice making system may include an ice producing subsystem to create ice from the received water, the ice producing system including a condenser; a high efficiency particulate filtered air positive air pressure subsystem to create and maintain a positive air pressure environment within the ice making system; and a controller. The high efficiency particulate filtered air positive air pressure subsystem includes a high efficiency particulate air filter having a detectable identification tag. The high efficiency particulate filtered air positive air pressure subsystem includes a sensor to detect the identification tag and collect information therefrom. The controller causes the ice producing subsystem to become non-operational when the controller determines, from information received from the sensor, that the high efficiency particulate air filter is not an authorized high efficiency particulate air filter.

The controller may cause the ice producing subsystem to become non-operational when the controller determines, from information received from the sensor, that the high efficiency particulate air filter has reached an end of life state.

The controller, through a user interface, may inform a user, based upon information received from the sensor, that the high efficiency particulate air filter has reached an end of life state.

It will be appreciated that variations of the above-disclosed embodiments and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the description above and the following claims.

What is claimed is:

1. An ice making system, comprising:

an ice zone for creating ice;

a mechanical zone for housing mechanical devices used in making ice; and a sealed condenser unit;

said sealed condenser unit including a fan, a condenser motor to operate the fan, and a condenser;

said condenser being cooled by air blown by said fan;

said sealed condenser unit being sealed with respect to said ice zone and said mechanical zone;

said sealed condenser unit having a first opening, exterior of said mechanical zone, to enable the operated fan to draw ambient air;

said sealed condenser unit having a second opening, exterior of said mechanical zone, to expel the air blown by the operated fan.

2. The ice making system as claimed in claim 1, wherein said sealed condenser unit is hermetically sealed with respect to said ice zone and said mechanical zone.

3. The ice making system as claimed in claim 1, wherein said sealed condenser unit is located within said mechanical zone.

4. The ice making system as claimed in claim 1, wherein said sealed condenser unit is attached to the ice making system and located outside said mechanical zone.

5. The ice making system as claimed in claim 1, wherein said hermetically sealed condenser unit is attached to the ice making system and located outside said mechanical zone.

6. An ice making system, comprising:

an ice zone for creating ice;

a mechanical zone for housing mechanical devices used in making ice, said mechanical devices including a compressor and a sump pump; and a hermetically sealed condenser unit;

said sealed condenser unit including a fan, a condenser motor to operate the fan, and a condenser;

said condenser being cooled by air blown by said fan;

said hermetically sealed condenser unit being hermetically sealed with respect to said mechanical zone;

said hermetically sealed condenser unit having a first opening, exterior of said mechanical zone, to enable the operated fan to draw ambient air from outside said mechanical zone;

said hermetically sealed condenser unit having a second opening, exterior of said mechanical zone, to expel the air blown by the operated fan.

7. The ice making system as claimed in claim 6, wherein said hermetically sealed condenser unit is hermetically sealed with respect to said ice zone.

8. The ice making system as claimed in claim 6, wherein said hermetically sealed condenser unit is located within said mechanical zone.

* * * * *